US012214399B2

(12) United States Patent
Miyake et al.

(10) Patent No.: US 12,214,399 B2
(45) Date of Patent: Feb. 4, 2025

(54) METHOD FOR MANUFACTURING PRESSED COMPONENT, AND SHAPE CORRECTION DIE

(71) Applicant: JFE STEEL CORPORATION, Tokyo (JP)

(72) Inventors: Hiroto Miyake, Tokyo (JP); Toyohisa Shinmiya, Tokyo (JP); Yuji Yamasaki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 573 days.

(21) Appl. No.: 17/611,854

(22) PCT Filed: Feb. 14, 2020

(86) PCT No.: PCT/JP2020/005850
§ 371 (c)(1),
(2) Date: Nov. 16, 2021

(87) PCT Pub. No.: WO2020/235152
PCT Pub. Date: Nov. 26, 2020

(65) Prior Publication Data

US 2022/0212243 A1 Jul. 7, 2022

(30) Foreign Application Priority Data

May 20, 2019 (JP) ..... 2019-094834

(51) Int. Cl.

| | |
|---|---|
| ***B21D 22/26*** | (2006.01) |
| ***B21D 22/24*** | (2006.01) |
| ***B21D 31/00*** | (2006.01) |
| ***B21D 37/10*** | (2006.01) |

(52) U.S. Cl.
CPC ..... *B21D 22/26* (2013.01); *B21D 22/24* (2013.01); *B21D 31/005* (2013.01); *B21D 37/10* (2013.01)

(58) Field of Classification Search
CPC ..... B21D 22/24; B21D 22/26; B21D 22/30; B21D 24/005; B21D 31/005; B21D 37/08; B21D 37/10; B21D 53/88
See application file for complete search history.

(56) References Cited

U.S. PATENT DOCUMENTS

2012/0119418 A1* 5/2012 Verbeek ..... B21D 22/26 425/398
2013/0104618 A1 5/2013 Daimaru
(Continued)

FOREIGN PATENT DOCUMENTS

CN 1165489 A 11/1997
CN 102905809 A 1/2013
(Continued)

OTHER PUBLICATIONS

Jun. 15, 2022 Extended European Search Repot issued in European Patent Application No. 20809032.4.
(Continued)

*Primary Examiner* — Debra M Sullivan
*Assistant Examiner* — Matthew Stephens
(74) *Attorney, Agent, or Firm* — Oliff PLC

(57) ABSTRACT

Warpage or torsion in a longitudinal direction is suppressed when an elongated curved component is manufactured by press forming. A method for manufacturing a pressed component includes a first step of press forming a metal sheet in a desired component shape using a first die, and a second step of press forming a formed product using a second die after the first step. In the second step, a cross section of a bent part and a vertical wall part are controlled to be opened depending on warpage at longitudinal end portions of the component by elastic recovery due to release from the first die, thereby suppressing the warpage.

16 Claims, 19 Drawing Sheets

(56) References Cited

U.S. PATENT DOCUMENTS

| | | | | |
|---|---|---|---|---|
| 2015/0367397 | A1* | 12/2015 | Uchiyama | B21D 53/88 72/379.2 |
| 2017/0014886 | A1 | 1/2017 | Shinmiya et al. | |
| 2017/0291208 | A1* | 10/2017 | Nishimura | B21D 47/01 72/379.2 |
| 2017/0333972 | A1 | 11/2017 | Nishimura et al. | |
| 2018/0065164 | A1* | 3/2018 | Sumikawa | B21D 22/21 72/379.2 |
| 2018/0093315 | A1* | 4/2018 | Kubo | B21D 5/01 72/379.2 |
| 2020/0384522 | A1 | 12/2020 | Flehmig et al. | |

FOREIGN PATENT DOCUMENTS

| | | | | |
|---|---|---|---|---|
| CN | 106029248 | A | 10/2016 | |
| CN | 107148320 | A | 9/2017 | |
| EP | 0 795 364 | A1 | 9/1997 | |
| EP | 1 338 351 | A1 | 8/2003 | |
| JP | 2006289480 | A * | 10/2006 | B21D 22/26 |
| JP | 2011-206789 | A | 10/2011 | |
| JP | 5382281 | B1 | 1/2014 | |
| JP | 2016-150354 | A | 8/2016 | |
| JP | 2016-203255 | A | 12/2016 | |
| JP | 2018-020350 | A | 2/2018 | |
| JP | 6376048 | B2 | 8/2018 | |
| WO | 2018/127480 | A1 | 7/2018 | |

OTHER PUBLICATIONS

Feb. 27, 2023 Office Action issued in Chinese Patent Application No. 202080037090.5.

Jul. 31, 2020 Decision to Grant a Patent issued in Japanese Patent Application No. 2020-527978.

Apr. 21, 2020 International Search Report issued in International Patent Application No. PCT/JP2020/005850.

* cited by examiner

METHOD FOR MANUFACTURING PRESSED COMPONENT, AND SHAPE CORRECTION DIE

TECHNICAL FIELD

The present invention relates to a technology for providing a formed product (pressed component) formed of a component shape having a hat-shaped cross-sectional shape and a curved part being curved so as to be convex toward one side of a top sheet part in a width direction when viewed in plan view along a longitudinal direction of the top sheet part. The hat-shaped cross-sectional shape of the component shape may have or may not have a flange part continuous with vertical wall parts.

BACKGROUND ART

In recent years, in order to reduce in weight of a vehicle body or improve collision safety, it has been required to apply high tensile strength steel to a vehicle body frame component for automobiles. However, since the high tensile strength steel has poor ductility, cracks easily occur. Furthermore, since the high tensile strength steel has a high strength, defects in dimensional accuracy tend to be increased due to wrinkles or springback.

In addition, a vehicle body component such as a front pillar or a member component are a formed product having a hat-shaped cross-sectional shape and a curved shape in a longitudinal direction, and including a top sheet part, and vertical wall parts and flange parts continuous with the top sheet part. In the formed product having such a shape, the cross section is changed due to the springback (elastic recovery), and also, warpage that longitudinal end portions of the component are lifted up or dropped occurs in the longitudinal direction, or defects that the cross section of the component end portion is twisted with respect to the cross section at the center of the component in the longitudinal direction easily occurs. Furthermore, since the formed product has an elongated component shape in the longitudinal direction, the longitudinal end portions of the component are greatly warped or twisted even if there are small dimensional accuracy defects such as less warpage or torsion in the vicinity of the center in the longitudinal direction. Therefore, it is very less likely to secure the dimensional accuracy of the formed product having such a component shape described above.

Several technologies have been proposed as measures of defects in dimensional accuracy of the elongated component having such a hat-shaped cross-sectional shape and curved along the longitudinal direction.

For example, PTL 1 has proposed a press forming method of slightly bending a flange part on a curved inner side (concave side of the curved part) to an elongated component having a hat-shaped cross-sectional shape and curved in a longitudinal direction in a first forming step, and additionally bending the flange part on the curved inner side until a formed product is made into a product shape in a second step to reduce a stress that causes torsion of the component end portion.

Further, PTL 2 has proposed a press forming method of providing an excessive thick part on a metal sheet before press forming, and hooking the excessive thick part on a vertical wall part forming part during press forming to promote in-plane rotation of the material in the metal sheet and reduce a stress that causes torsion or warpage in the longitudinal direction.

CITATION LIST

Patent Literatures

PTL 1: JP 5382281 B
PTL 2: JP 6376048 B

SUMMARY OF INVENTION

Technical Problem

However, in the press forming method described in PTL 1, it is possible to reduce a tensile stress, which is caused by torsion, generated in the flange part on the concave side (curved inner side) in the longitudinal curved part at the center of a thickness in the longitudinal direction. However, the method disclosed in PTL 1 has a small effect of reducing of the component in the longitudinal warpage of the component.

Further, in the press forming method disclosed in PTL 2, yield of the material may deteriorate because the excessive thick part is provided on the metal sheet before forming. Furthermore, forming while hooking the excessive thick part on the vertical wall part is performed in a very unstable state in consideration of mass production by press forming. In addition, in such a method, when a position for placing the metal sheet before press forming or a friction coefficient between the metal sheet and a die is varied, the in-plane rotation amount of the material given to the metal sheet is varied, and thus an improvement amount of the dimensional accuracy is also varied.

The present invention has been made by focusing on the problem described above, and an object of the present invention is to suppress warpage or torsion in a longitudinal direction of a formed product formed of a component shape having a hat-shaped cross-sectional shape and a curved part being curved so as to be convex toward one side of a top sheet part in a width direction when viewed in plan view along a longitudinal direction of the top sheet part.

Solution to Problem

If the formed product of a component shape is press-formed from a metal sheet as a material, the formed product of the component shape having a hat-shaped cross-sectional shape with a top sheet part and vertical wall parts and flange parts continuous with the top sheet part and a curved part curved so as to be convex toward one side of the top sheet part in a width direction when viewed in plan view along a longitudinal direction of the top sheet part, springback occurs in the formed product when the die is released. The present inventors have intensively studied the press forming method of suppressing warpage of the cross section that the longitudinal end portions of the component are lifted up or dropped due to the springback occurred when the die is released, and suppressing torsion of the cross section generated in conjunction with the warpage. As a result of the studies, the present inventors have found that the press forming is performed in a direction in which warpage is suppressed due to the springback of the component end portion by correcting the shape of the formed product so that an angle formed by the vertical wall parts on the concave side (inner side) in the longitudinal curved part and on the convex side (outer side) in the curved part with respect to the top sheet part are changed, according to a warping direction due to the springback of the longitudinal end portions of the component. The present invention has been made based on such findings.

That is, in order to solve the problem, an aspect of the present invention is summarized as that a method for manufacturing a pressed component in which a metal sheet is press-formed in a component shape as a desired component shape that has a hat-shaped cross-sectional shape and has a curved part that is curved to be convex toward one side of a top sheet part in a width direction when viewed in plan view along a longitudinal direction of the top sheet part, the hat-shaped cross-sectional shape having continuous vertical wall parts on both sides of the top sheet part in the width direction via a bent part, to manufacture a formed product, the method includes a first step of press forming the metal sheet in the component shape using a first die, and a second step of press forming the formed product using a second die after the first step, in which when the component shape of the formed product after release from the first die is defined as a first component shape, in a case where longitudinal end portions of the component are lifted up to a front side of the top sheet part by elastic recovery due to the release from the first die, press forming of performing at least one of first forming in which angle formed by the vertical wall part with respect to the top sheet part on a concave side in the curved part is smaller than that of the first component shape and second forming in which an angle formed by the vertical wall part with respect to the top sheet part on a convex side in the curved part is larger than that of the first component shape is performed in the second step, and in a case where the longitudinal end portions of the component are dropped to a back side of the top sheet part by elastic recovery due to the release from the first die, press forming of performing at least one of third forming in which an angle formed by the vertical wall part with respect to the top sheet part on the concave side in the curved part is larger than that of the first component shape and fourth forming in which an angle formed by the vertical wall part with respect to the top sheet part on the convex side in the curved part is smaller than that of the first component shape is performed in the second step.

Further, another aspect of the present invention is summarized as that a shape correction die which is a die for shape correction of a formed product which is obtained by performing press forming, with a first die, in a component shape that has a hat-shaped cross-sectional shape and has a curved part that is curved to be convex toward one side of a top sheet part in a width direction when viewed in plan view along a longitudinal direction of the top sheet part, the hat-shaped cross-sectional shape having continuous vertical wall parts on both sides of the top sheet part in the width direction via a bent part, and obtained in a case where longitudinal end portions of the component are lifted up to a front side of the top sheet part by elastic recovery due to release from the first die, in which a shape of a die forming surface at a portion forming at least a part of the bent part located on a concave side in the curved part from the top sheet part toward the vertical wall part is different from that of the first die.

Further, still another aspect of the present invention is summarized as that a shape correction die which is a die for shape correction of a formed product which is obtained by performing press forming, with a first die, in a component shape that has a hat-shaped cross-sectional shape and has a curved part that is curved to be convex toward one side of a top sheet part in a width direction when viewed in plan view along a longitudinal direction of the top sheet part, the hat-shaped cross-sectional shape having continuous vertical wall parts on both sides of the top sheet part in the width direction via a bent part, and obtained in a case where longitudinal end portions of the component are dropped to a back side of the top sheet part by elastic recovery due to release from the first die, in which a shape of a die forming surface at a portion forming at least a part of the bent part located on a convex side in the curved part from the top sheet part toward the vertical wall part is different from that of the first die.

The angle formed by the vertical wall part with respect to the top sheet part herein is an obtuse angle, and indicates an angle formed by a back surface of the top sheet part and an inner surface of the vertical wall part.

Advantageous Effects of Invention

According to the embodiment of the present invention, it is possible to suppress warpage or torsion in the longitudinal direction generated in the pressed component, when the formed product is manufactured by press forming, the formed product formed of a component shape having a hat-shaped cross-sectional shape and a curved part being curved so as to be convex toward one side of a top sheet part in a width direction when viewed in plan view along a longitudinal direction of the top sheet part.

BRIEF DESCRIPTION OF DRAWINGS

FIG. 1A to 1C are views illustrating a component shape of a formed product according to an embodiment based on the present invention, in which FIG. 1A is a perspective view, FIG. 1B is a plan view, FIG. 1C is a cross-sectional view taken along line A-A' at a position of a curved part in FIG. 1B;

FIG. 19A to 19C are views illustrating a component shape of a formed product according to an Example, in which FIG. 19A is a perspective view, FIG. 19B is a plan view, FIG. 19C is a cross-sectional view taken along line A-A' at a position of a curved part in FIG. 19B;

DESCRIPTION OF EMBODIMENTS

Next, an embodiment according to the present invention will be described with reference to the drawings.

Figure 1A:
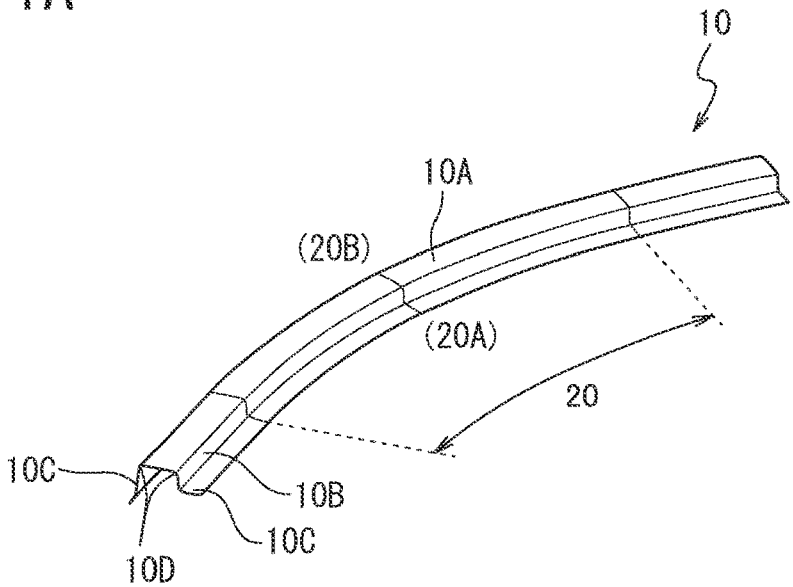
Figure 1B:
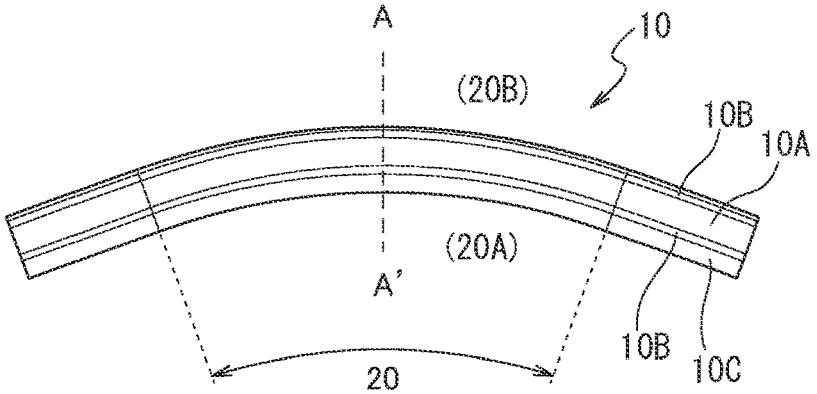
Figure 1C:
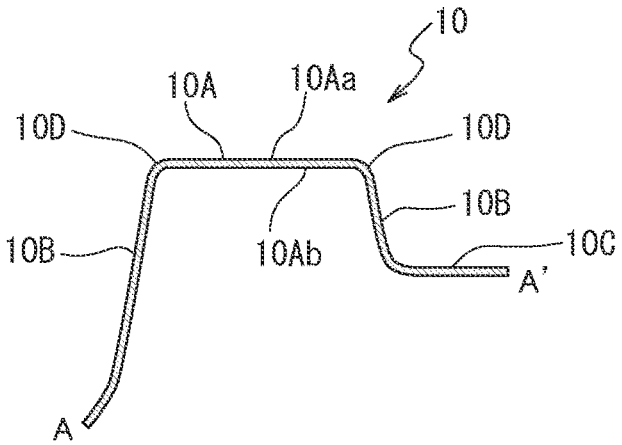

As illustrated in FIG. 1, the present embodiment describes a technology for manufacturing a pressed component formed of a desired formed product 10 by press forming a metal sheet 1 in a component shape (hereinafter, referred to as an elongated curved component shape) having a hat-shaped cross-sectional shape with continuous vertical wall parts 10B on both sides of a top sheet part 10A in a width direction via a bent part 10D, and a curved part 20 curved so as to be convex toward one side of the top sheet part 10A in the width direction when viewed in plan view along a longitudinal direction of the top sheet part 10A. The expression "elongated" means that the component shape has a length in the longitudinal direction longer than that in a width of the top sheet part.

In the following description, a case in which the formed product 10 formed of an elongated curved component shape having a hat-shaped cross-sectional shape and flange parts 10C on end portions of the vertical wall part 10B is manufactured as a desired formed product 10 will be described by means of an example as illustrated in FIG. 1. However, the present invention is to be also able to be applied to manufacturing of a formed product formed of an elongated curved component shape having a hat-shaped cross-sectional shape without the flange parts 10C. In addition, the manufactured formed product 10 may be a final product or a semi-final product.

Figure 2:
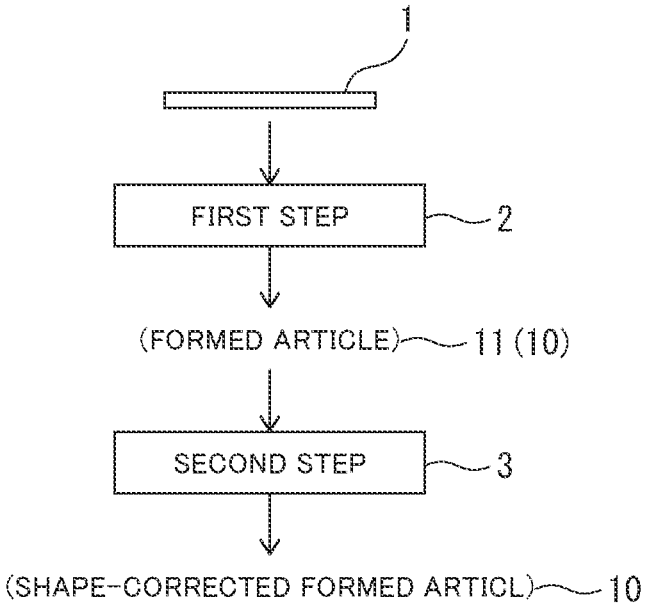
FIG. 2 is a diagram illustrating a process of a manufacturing method according to an embodiment based on the present invention.

In the present embodiment, a pressing process includes at least a first step 2 and a second step 3 after the first step 2, as illustrated in FIG. 2.

<Metal Sheet 1>

The press-formed metal sheet 1 is, for example, a metal sheet 1 having a blank shape in which a component shape of the desired formed product 10 is developed. However, the metal sheet 1 having a large area than that required for the component shape may be applied as a blank material (press-formed metal sheet 1) as long as the yield is within an allowable range. The shape of the metal sheet 1 is not particularly limited.

Particularly, in the present embodiment, the metal sheet 1 having a steel sheet (high tensile steel) with a tensile strength of 440 MPa or more and preferably 980 MPa or more is able to be used when the metal sheet 1 is press-formed in an elongated curved component shape. In this case, it is possible to reduce defects in dimensional accuracy more effectively.

<First Step 2>

In the first step 2, the metal sheet 1 (blank material) is subjected to press forming in the component shape using a first die. Here, the desired formed product 10 may be fabricated by a multi-stage pressing process. In this case, for example, it is possible to allow the final step of the multi-stage pressing process to be the first step 2. As such, the pressing process may have one or two or more other pressing steps as a pretreatment of the first step 2.

<Die and Press Forming Method>

For example, drawing or bending is adopted to the press forming of the first step 2.

Figure 3:
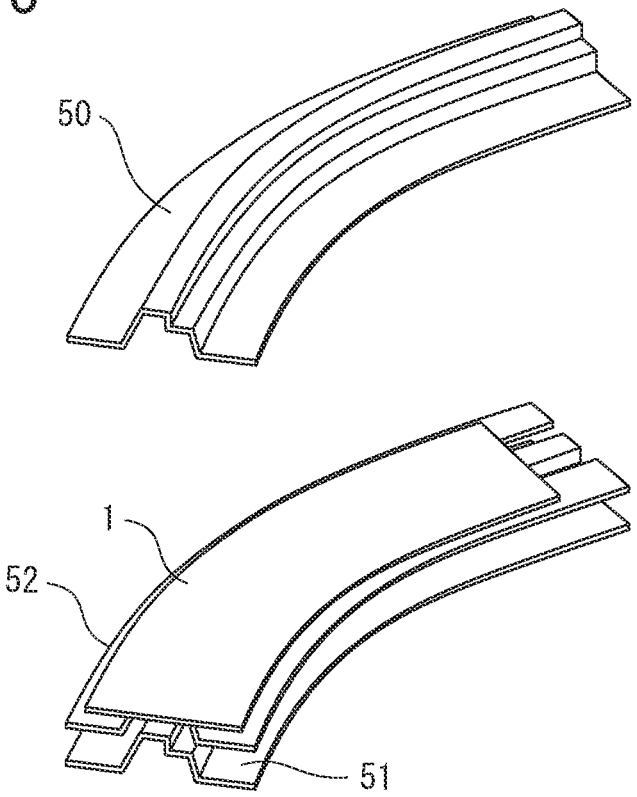
FIG. 3 is a view illustrating an example of a die for drawing.
Figure 4A:
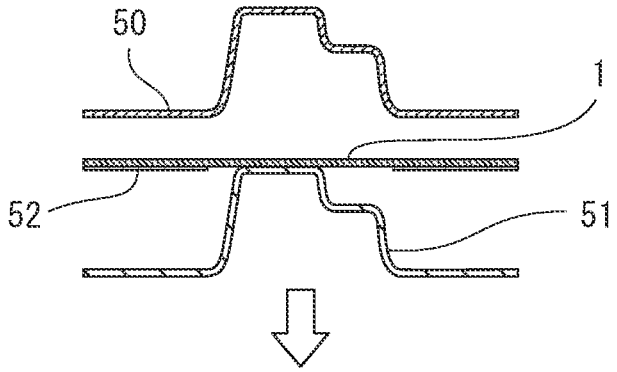
FIG. 4A to 4D are views illustrating a processing example of the drawing.
Figure 4B:
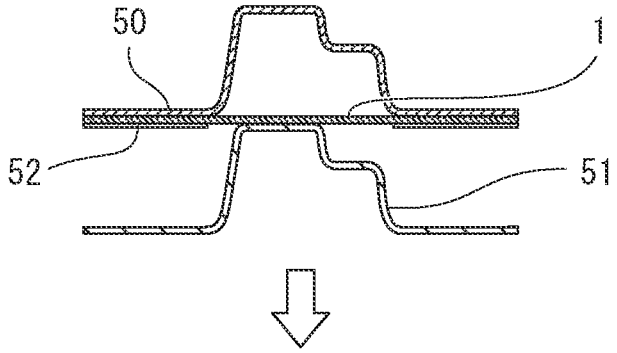
Figure 4C:
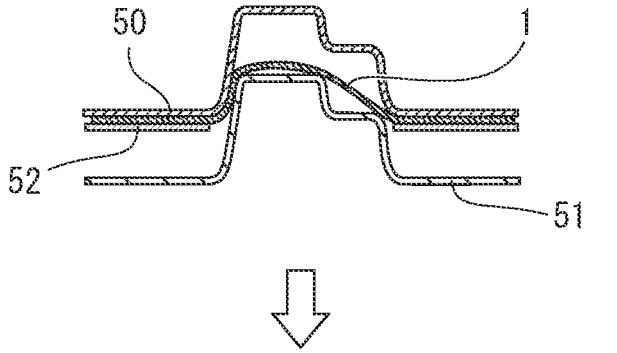
Figure 4D:
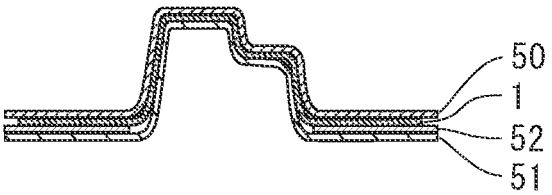

When the first step 2 is drawing, the first die has a configuration as illustrated in FIG. 3, for example. In FIG. 3, the first die is formed of an upper die having a die 50 and a lower die having a punch 51 and a blank holder 52. Then, as illustrated in FIG. 4, the drawing in this example is started from a state in which the metal sheet 1 is placed on the blank holder 52 before the drawing (see FIG. 4A). In this state, the die 50 is lowered, and the metal sheet 1 is sandwiched between the die 50 and the blank holder 52 (see FIG. 4B). Thereafter, the blank holder 52 applies a pressure in a direction opposite to a pressing direction. Therefore, the die 50 is further lowered (see FIG. 4C), and finally, reaches a bottom dead center to complete the processing (see FIG. 4D).

Figure 5:
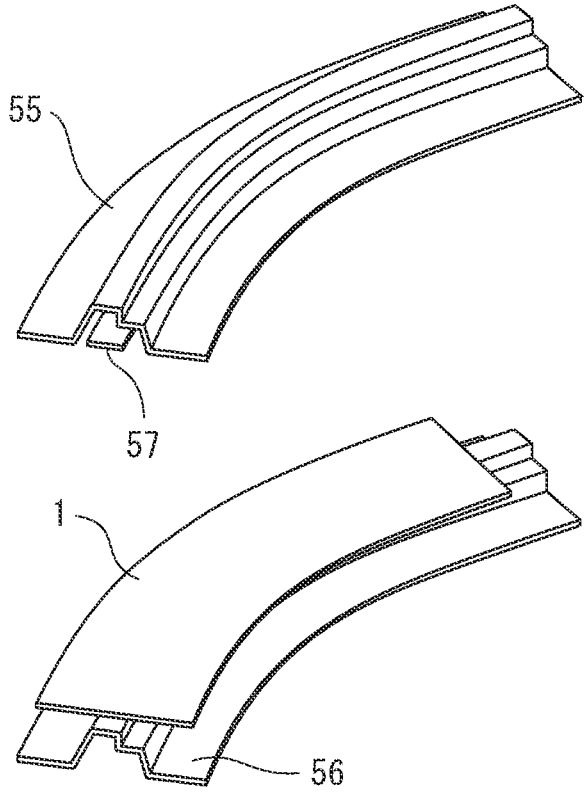
FIG. 5 is a view illustrating an example of a die for bending.
Figure 6A:
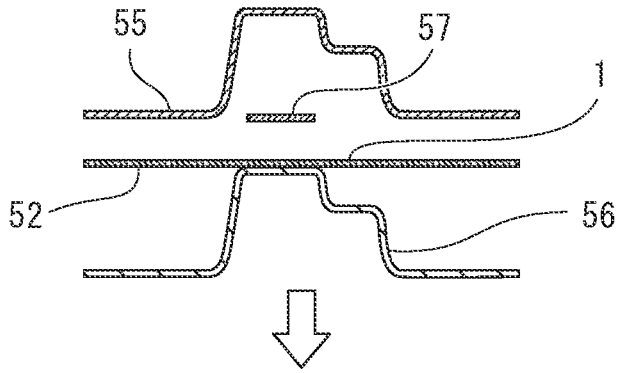
FIG. 6A to 6D are views illustrating a processing example of the bending.
Figure 6B:
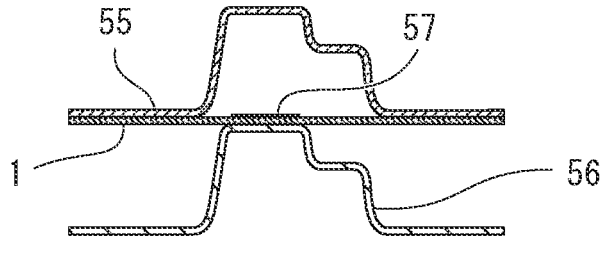
Figure 6C:
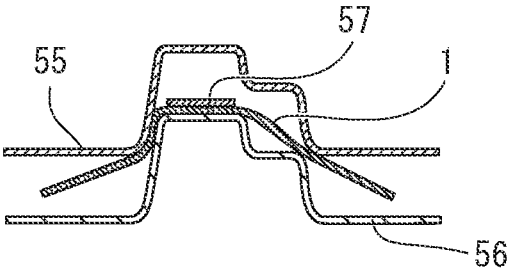
Figure 6D:
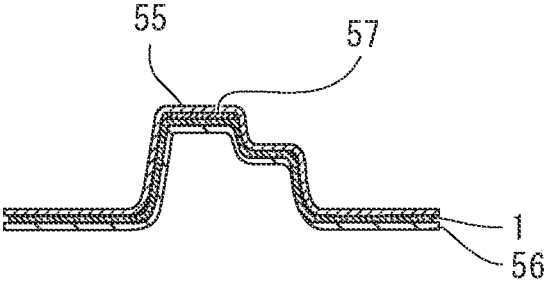

When the first step 2 is bending, the first die has a configuration as illustrated in FIG. 5, for example. In FIG. 5, the first die is formed of an upper die having a die 55 and a pad 57, and a lower die having a punch 56. Then, as illustrated in FIG. 6, the bending in this example is started from a state in which the metal sheet 1 is placed on the punch 56 before the bending (see FIG. 6A). In this state, the upper die is lowered, and the top sheet part 10A of the component is sandwiched between the pad 57 and the punch 56 (see FIG. 6B). Thereafter, the pad 57 applies a pressure in the same direction as the pressing direction. Therefore, the upper die is further lowered (see FIG. 6C), and finally, reaches a bottom dead center to complete the processing (see FIG. 6D).

Here, in the second step 3, the press forming is performed as the bending by using a die for bending which is the same die as illustrated in FIG. 5.

<Second Step 3>

In the second step 3, the formed product 10 after the first step 2 is press-formed using the second die, and subjected to shape correction of a formed product 11 (pressed component). That is, in the second step 3, the press forming is performed on the formed product 10 of the component shape (also referred to as a first component shape) after released from the first die in order to correct longitudinal warpage of the component caused by elastic recovery due to the release from the first die. The second die used in the second step 3 is formed of a shape correction die.

Next, press forming in the second step 3 will be described.

Figure 7A:
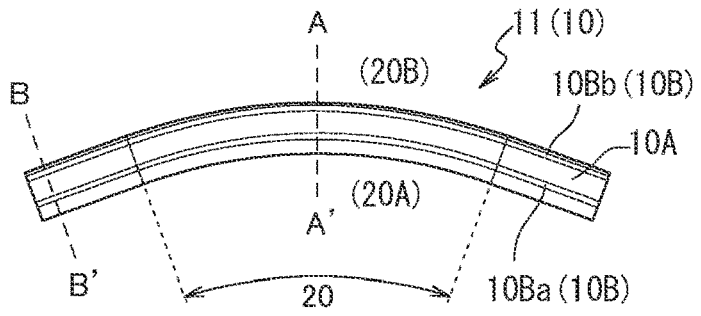
FIG. 7A to 7D are views illustrating a state of a formed product (formed product 11) after the first step.
Figure 7B:
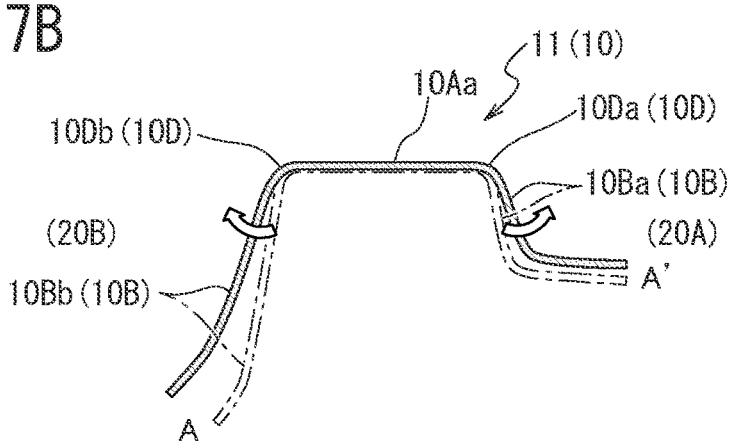
Figure 7C:
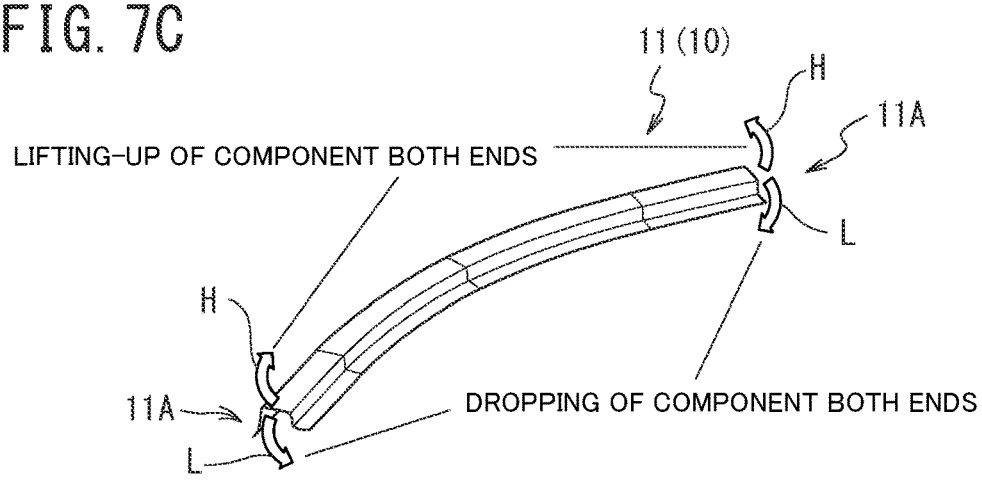

In the second step 3, it is determined whether warpage in the formed product 11 formed of a first component shape caused by elastic recovery due to the release from the first die is a first warp pattern H or a second warp pattern L, as illustrated in FIG. 7C. The first warp pattern H is a warp pattern in which the longitudinal end portions of the component are lifted up to a front side 10Aa of the top sheet part 10A. The second warp pattern Lisa warp pattern in which the longitudinal end portions of the component are dropped to a back side 10Ab of the top sheet part 10A. In the second step 3, another die is used as the second die to be used depending on whether the warp pattern is the first warp pattern H or the second warp pattern L. Here, the warp pattern by the elastic recovery is able to be determined in advance by forming analysis or a product actually subjected to the treatment of the first step 2.

Figure 8A:
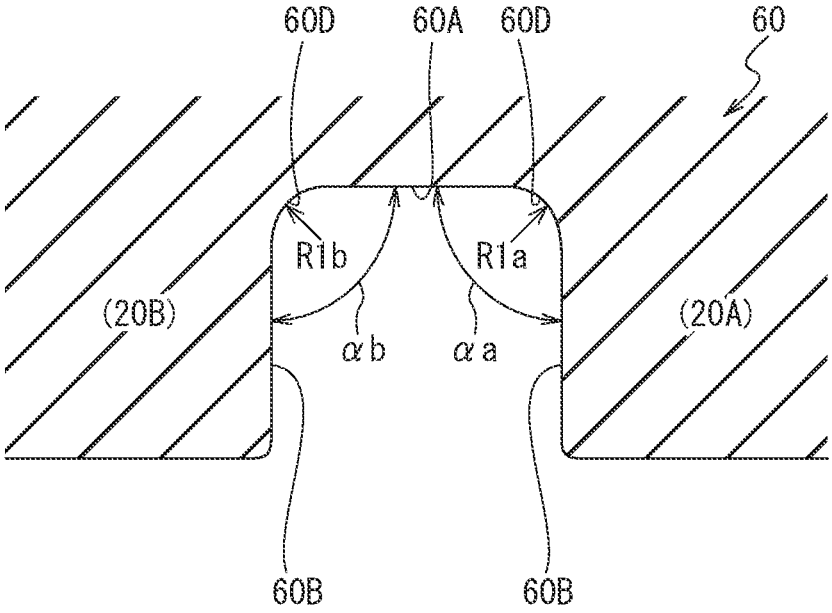
FIGS. 8A and 8B are schematic views illustrating a relationship between a first die (a) of the first step and a second die (b) of the second step.
Figure 8B:
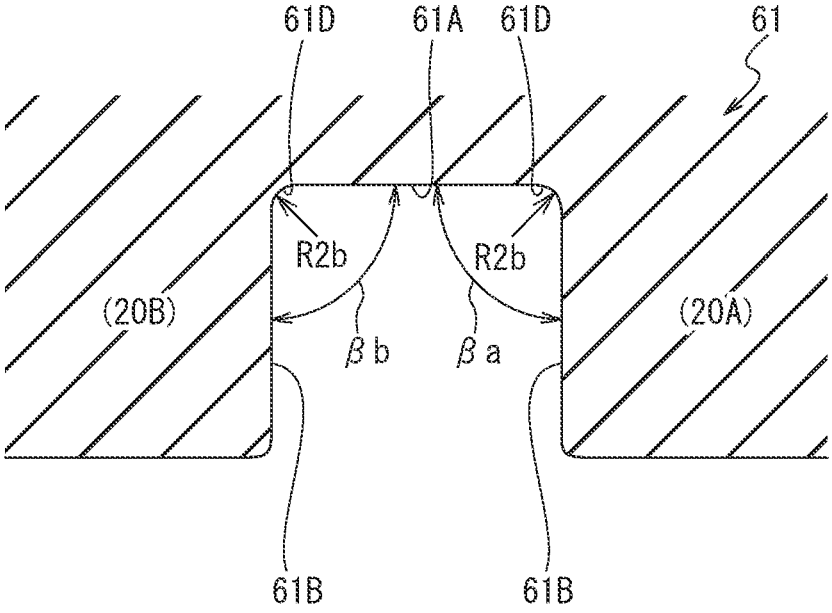

In the following description, a relationship between the first die of the first step 2 and the second die of the second step 3 will be described with reference to FIG. 8. FIG. 8 illustrates a die schematically illustrating a forming surface (shape in the die) of the die the upper die, and the forming surface of the punch of the lower die has the same shape as the forming surface of the die. FIG. 8A illustrates a first die 60, in which a reference sign 60A is a forming surface that abuts on the surface of the top sheet part 10A, a reference sign 60B is a forming surface that abuts on the vertical wall part 10B, and a reference sign 60D is a forming surface that forms the bent part 10D. FIG. 8B illustrates a second die 61, in which a reference sign 61A is a forming surface that abuts on the surface of the top sheet part 10A, a reference sign 61B is a forming surface that abuts on the vertical wall part 10B, and a reference sign 61D is a forming surface that forms the bent part 10D. The abutting on the top sheet part 10A includes a case of abutting via a pad.

After the first step 2 is completed and the die is released, the shape of the formed product 10 is also referred to as the first component shape.

"First Warp Pattern H"

During the press forming in the first step 2, when the first warp pattern H in which the longitudinal end portions of the component are lifted up to the front side 10Aa of the top sheet part 10A is generated on the formed product 11 formed of the first component shape by the elastic recovery due to the release from the first die, next press forming is performed on the formed product 11 in the second step 3.

Figure 9:
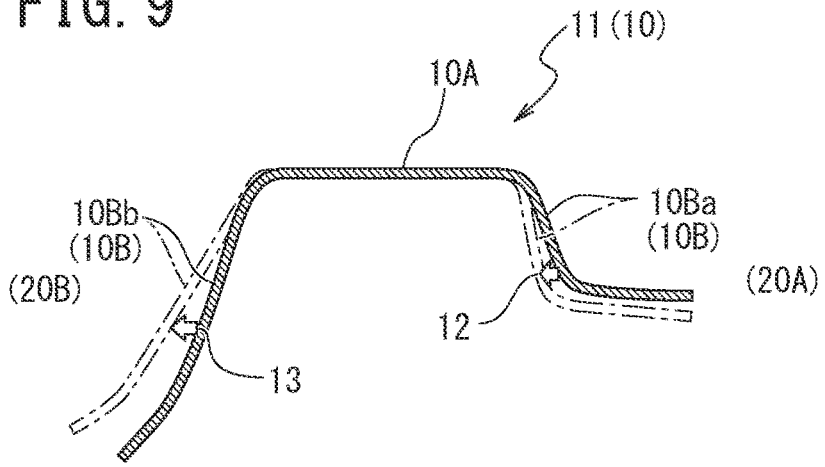
FIG. 9 is a view illustrating a processing example of the second step for a first warp pattern.

That is, press forming that performs at least one of first forming (processing of reference sign 12 in FIG. 9) and second forming (processing of reference sign 13 in FIG. 9) is performed in the second step 3 as illustrated in FIG. 9. In the first forming (processing of reference sign 12 in FIG. 9), forming is performed so that an angle formed by the vertical wall part 10Ba with respect to the top sheet part 10A on a concave side 20A of the curved part 20 is smaller than that of the first component shape in the elongated curved component shape formed of the first component shape. In the second forming (processing of reference sign 13 in FIG. 9), forming is performed so that an angle formed by a vertical wall part 10Bb with respect to the top sheet part 10A on a convex side 20B of the curved part 20 is larger than that of the first component shape in the elongated curved component shape formed of the first component shape.

(1) Regarding First Forming (Processing of Reference Sign 12 in FIG. 9)

(1-1) First Method of First Forming

In the first forming, the forming is performed with a radius of curvature of at least a part of the bent part 10D between the top sheet part 10A and the vertical wall part 10Ba located on the concave side 20A of the curved part 20, which is different from a radius of curvature in the first step 2.

In this case, for example, a die in which a radius of curvature R2*a* of a die forming surface 61D at a portion forming at least a part of the bent part 10D located on the concave side 20A of the curved part 20 is a radius different from the radius of curvature R1*a* of the die forming surface 60D at a portion forming at least a part of the bent part 10D located on the concave side 20A of the curved part 20 in the first die, is adopted as the second die.

The expression "at least a part of the bent part 10D" described herein means a part of the component in the longitudinal direction of the bent part 10D located at the curved part 20. It is preferable that the part is targeted at ¼ or more of the bent part 10D of the curved part 20, and preferably the entire bent part 10D. The same applies to the following description.

The expression "radius of curvature" herein means a radius of curvature of a surface forming the bent part 10D from the top sheet part 10A toward the vertical wall part 10B.

The die for forming the bent part 10D and the like is formed of an upper die and a lower die, and is formed by sandwiching the metal sheet 1 between the upper die and the lower die. Therefore, the forming surfaces are present on both the upper die (die) and the lower die (punch). However, the shape of the forming surface of the bent part 10D has the substantially same shape as those of the forming surfaces on both the upper die (die) and the lower die (punch), and any forming surface may thus be used. If the forming surface of the upper die and the forming surface of the lower die facing each other have different cross-sectional shapes, the cross-sectional shape may be changed individually for the upper die and the lower die. The same applies to the following forming.

Moreover, the expression "different from the radius of curvature" means that the radius of curvature is larger or smaller than the radius of curvature in the first die.

As will be described later, the press forming is performed with the second die by using a die having a different radius of curvature R2*a* of the die forming surface at a portion forming at least a part of the bent part 10D from that of the first die as a shape of the second die. As a result, it is possible to perform forming so that an angle formed by the vertical wall part 10B with respect to the top sheet part 10A on the concave side 20A of the curved part 20 is smaller than that of the first component shape. As a result, the warpage in which the longitudinal end portions of the component are lifted up to the front side 10Aa of the top sheet part 10A in the longitudinal direction is corrected, which will be described later.

At this time, it is preferable that angles $\alpha a$ and $\alpha b$ formed by the forming surfaces abutting on the vertical wall part 10B with respect to the forming surface abutting on the top sheet part 10A in the first die and angles $\beta a$ and $\beta b$ formed by the forming surface abutting on the vertical wall part 10B with respect to the forming surface abutting on the top sheet part 10A in the second die are formed to have the same angles.

For example, the forming surface of the second die has the same surface shape as the forming surface of the first die, except for the die forming surface at the portion where at least a part of the bent part 10D is formed. However, the shape of the forming surface other than the angles βa and βb formed by the forming surface abutting on the vertical wall part 10B with respect to the forming surface abutting on the top sheet part 10A may be different from that of the first die.

(1-2) Second Method of First Forming

In the first forming, at least a part of the bent part 10D between the top sheet part 10A and the vertical wall part 10Ba located on the concave side 20A of the curved part 20 is formed in a shape bent stepwise at a plurality of points from the top sheet part 10A toward the vertical wall part 10B. For example, as the forming surface of the second die, a shape of the die forming surface at a portion forming at least a part of the bent part 10D between the top sheet part 10A and the vertical wall part 10B located on the concave side 20A of the curved part 20 is the shape bent stepwise at a plurality of points from the top sheet part 10A toward the vertical wall part 10B. In addition, a die having a shape different from the shape of the die forming surface at a portion forming at least a part of the bent part 10D between the top sheet part 10A and the vertical wall part 10Ba located on the concave side 20A of the curved part 20 in the first die, is adopted.

Figure 10A:
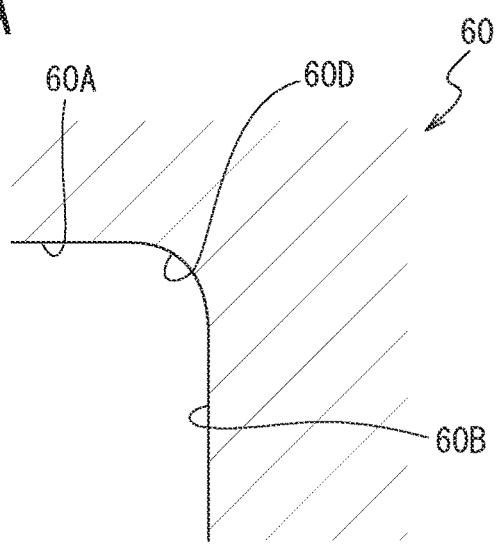
FIGS. 10A and 10B are views illustrating an example in which a cross-sectional shape of the bent part is bent stepwise at a plurality of points.
Figure 10B:
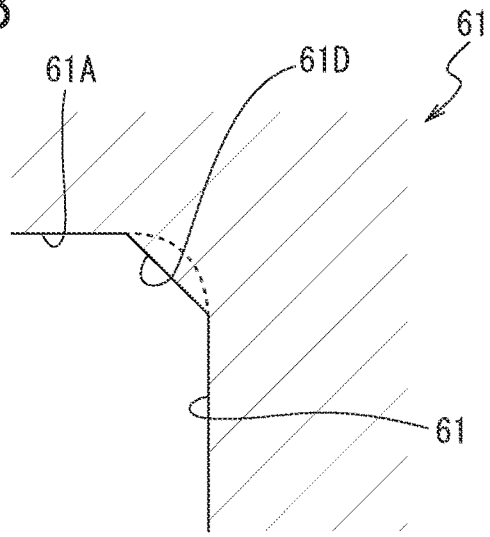

The shape that is bent stepwise at the plurality of points from the top sheet part 10A toward the vertical wall part 10B is realized by, for example, chamfering and changing an arc cross-sectional shape 60D of the bent part 10D in the first die into a chamfered shape 61D, as illustrated in FIG. 10. In this case, the shape is bent stepwise at two points from the top sheet part 10A toward the vertical wall part 10B.

As will be described later, as the second die, the press forming is performed with the second die by using a die in which the shape of the bent part 10D is changed from the arc shape of the bent part 10D of the first die to the shape bent stepwise at the plurality of points. As a result, it is possible to perform forming so that an angle formed by the vertical wall part 10B with respect to the top sheet part 10A on the concave side 20A of the curved part 20 is smaller than that of the first component shape. As a result, the warpage in which the longitudinal end portions of the component are lifted up to the front side 10Aa of the top sheet part 10A is corrected, as will be described later.

At this time, it is preferable that angles αa and αb formed by the forming surfaces abutting on the vertical wall part 10B with respect to the forming surface abutting on the top sheet part 10A in the first die and angles βa and βb formed by the forming surface abutting on the vertical wall part 10B with respect to the forming surface abutting on the top sheet part 10A in the second die are formed to have the same angles.

For example, the forming surface of the second die has the same surface shape as the forming surface of the first die, except for the die forming surface at the portion where at least a part of the bent part 10D is formed. However, the shape of the forming surface other than the angles formed by the forming surface abutting on the vertical wall part 10B with respect to the forming surface abutting on the top sheet part 10A may be different from that of the first die.

(1-3) Third Method of First Forming

In the first forming, the forming is performed on the forming surface of the second die for forming at least a part of the vertical wall part 10B in the longitudinal direction in the portion of the vertical wall part 10B located on the concave side 20A of the curved part 20 by using the second die in which the angle βa of the forming surface that abuts on the vertical wall part 10B with respect to the forming surface that abuts on the top sheet part 10A is smaller than the angle αa on the forming surface for forming the same point with the first die.

(2) Regarding Second Forming (Processing of Reference Sign 13 in FIG. 9)

In the second forming, the forming is performed on the angle αb on the forming surface of the second die for forming at least a part of the vertical wall part 10B in the longitudinal direction in the portion of the vertical wall part 10B located on the convex side 20B of the curved part 20 by using the second die in which the angle βb of the forming surface that abuts on the vertical wall part 10B with respect to the forming surface that abuts on the top sheet part 10A is larger than that of the forming surface for forming the same point with the first die.

Alternatively, in the second forming, the forming may be performed so that the angle formed by the vertical wall part 10B with respect to the top sheet part 10A on the convex side 20B of the curved part 20 is larger than that of the first component shape by using the cross-sectional shape of at least a part of the bent part 10D between the top sheet part 10A and the vertical wall part 10B located on the convex side 20B of the curved part 20 as a shape different from the cross-sectional shape in the first step 2. As will be described later, the cross-sectional shape is adjusted, such that it is possible to deform the vertical wall part 10B in the opening direction.

"Case of Second Warp Pattern L"

During the press forming in the first step 2, when the second warp pattern L in which the longitudinal end portions of the component are dropped to the back side 10Ab of the top sheet part 10A is generated on the formed product 10 formed of the first component shape by the elastic recovery due to the release from the first die, next press forming is performed on the formed product 10 of the first component shape in the second step 3.

Figure 11:
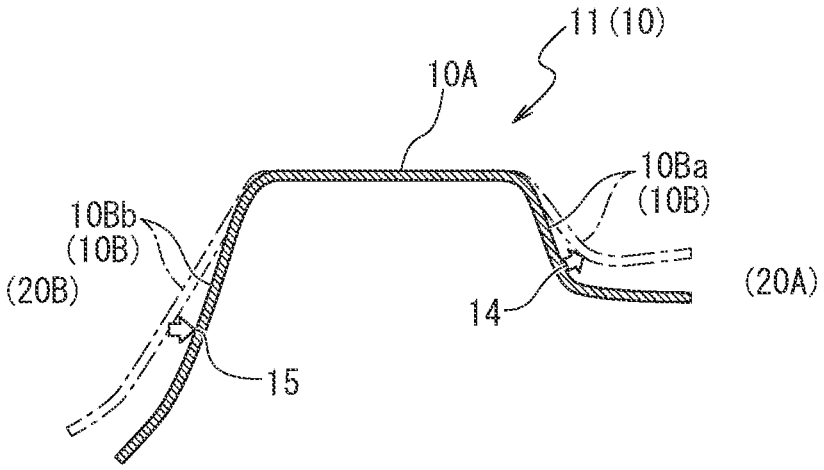
FIG. 11 is a view illustrating a processing example of the second step for a second warp pattern.

That is, at least one of third forming (processing of reference sign 14 in FIG. 11) and fourth forming (processing of reference sign 15 in FIG. 11) is performed in the second step 3 as illustrated in FIG. 11. In the third forming (processing of reference sign 14 in FIG. 11), forming is performed so that the angle formed by the vertical wall part 10Ba with respect to the top sheet part 10A on the concave side 20A of the curved part 20 is larger than that of the first component shape in the elongated curved component shape of the first component shape. In the fourth forming (processing of reference sign 15 in FIG. 11), forming is performed so that the angle formed by the vertical wall part 10Bb with respect to the top sheet part 10A on the convex side 20B of the curved part 20 is smaller than that of the first component shape in the elongated curved component shape of the first component shape.

(1) Regarding Third Forming (Processing of Reference Sign 14 in FIG. 11)

In the third forming, the forming is performed on the forming surface of the second die for forming at least a part of the vertical wall part 10B in the longitudinal direction in the portion of the vertical wall part 10Ba located on the concave side 20A of the curved part 20 by using the second die in which the angle βa of the forming surface that abuts on the vertical wall part 10B with respect to the forming surface that abuts on the top sheet part 10A is larger than that of the forming surface for forming the same point with the first die.

Alternatively, in the second forming, the angle formed by the vertical wall part 10Bb with respect to the top sheet part 10A on the convex side 20B of the curved part 20 may be larger than that of the first component shape by using the cross-sectional shape of at least a part of the bent part 10D between the top sheet part 10A and the vertical wall part 10Ba located on the concave side 20A of the curved part 20 as a shape different from the cross-sectional shape in the first step 2. As will be described later, the cross-sectional shape is adjusted, such that it is possible to deform the vertical wall part 10B in the Opening Direction.

(2) Regarding Fourth Forming (Processing of Reference Sign 15 in FIG. 11)

(2-1) First Method of Fourth Forming

In the fourth forming, the forming is performed with a radius of curvature R2*b* of at least a part of the bent part 10D between the top sheet part 10A and the vertical wall part 10Bb located on the convex side 20B of the curved part 20, which is different from a radius of curvature in the first step 2.

In this case, for example, a die in which a radius of curvature R2*b* of the die forming surface at a portion forming at least a part of the bent part 10D located on the convex side 20B of the curved part 20 is a radius different from the radius of curvature R1*b* of the die forming surface at a portion forming at least a part of the bent part 10D located on the convex side 20B of the curved part 20 in the first die, is adopted as the second die.

As will be described later, the press forming is performed with the second die by using a die having the radius of curvature R2*b* of the die forming surface at a portion forming at least a part of the bent part 10D different from that of the shape of the first die as a shape of the second die. Therefore, it is possible to perform forming so that the angle formed by the vertical wall part 10Bb with respect to the top sheet part 10A on the convex side 20B of the curved part 20 is smaller than that of the first component shape. As a result, as will be described later, warpage in which the longitudinal end portions of the component are dropped to the back side 10Ab of the top sheet part 10A in the longitudinal direction is corrected.

At this time, it is preferable that angles formed by the forming surfaces abutting on the vertical wall part 10B with respect to the forming surface abutting on the top sheet part 10A in the first die and angles formed by the forming surfaces abutting on the vertical wall part 10B with respect to the forming surface abutting on the top sheet part 10A in the second die are formed to have the same angles.

For example, the forming surface of the second die has the same surface shape as the forming surface of the first die, except for the die forming surface at the portion where at least a part of the bent part 10D is formed. However, the shape of the forming surface other than the angles βa and βb formed by the forming surface abutting on the vertical wall part 10B with respect to the forming surface abutting on the top sheet part 10A may be different from that of the first die.

(2-2) Second Method of Fourth Forming

In the first forming, at least a part of the bent part 10D between the top sheet part 10A and the vertical wall part 10Bb located on the convex side 20B of the curved part 20 is formed in a shape bent stepwise at a plurality of points from the top sheet part 10A toward the vertical wall part 10B. For example, a die in which the die forming surface at a portion forming at least a part of the bent part 10D between the top sheet part 10A and the vertical wall part 10Bb located on the convex side 20B in the curved part 20 has a shape different from that of the die forming surface at a portion forming at least a part of the bent part 10D between the top sheet part 10A and the vertical wall part 10Bb located on the convex side 20B in the curved part 20 in the first die as a shape of the surface that is bent stepwise at a plurality of points from the top sheet part 10A toward the vertical wall part 10B, is adopted as a second die.

The shape that is bent stepwise at the plurality of points from the top sheet part 10A toward the vertical wall part 10B is realized by, for example, chamfering and changing an arc cross-sectional shape of the bent part 10D in the first die into a chamfered shape, as illustrated in FIG. 10. In this case, the shape is bent stepwise at two points from the top sheet part 10A toward the vertical wall part 10B.

As will be described later, as the second die, the press forming is performed with the second die by using a die in which the shape of the bent part 10D is changed from the arc shape of the bent part 10D of the first die to the shape bent stepwise at the plurality of points. As a result, the forming is performed so that an angle formed by the vertical wall part 10Bb with respect to the top sheet part 10A on the convex side 20B of the curved part 20 is smaller than that of the first component shape. As a result, the warpage in which the longitudinal end portions of the component are lifted up to the front side 10Aa of the top sheet part 10A is corrected, as will be described later.

At this time, it is preferable that angles formed by the forming surfaces abutting on the vertical wall part 10B with respect to the forming surface abutting on the top sheet part 10A in the first die and angles formed by the forming surfaces abutting on the vertical wall part 10B with respect to the forming surface abutting on the top sheet part 10A in the second die are formed to have the same angles.

For example, the forming surface of the second die has the same surface shape as the forming surface of the first die, except for the die forming surface at the portion where at least a part of the bent part 10D is formed. However, the shape of the forming surface other than the angles formed by the forming surface abutting on the vertical wall part 10B with respect to the forming surface abutting on the top sheet part 10A may be different from that of the first die.

(2-3) Third Method of Fourth Forming

In the fourth forming, the forming is performed on the forming surface of the second die for forming at least a part of the vertical wall part 10Bb in the longitudinal direction in the portion of the vertical wall part 10B located on the convex side 20B of the curved part 20 by using the second die in which the angle βb of the forming surface that abuts on the vertical wall part 10B with respect to the forming surface that abuts on the top sheet part 10A is smaller than that of the forming surface for forming the same point with the first die.

In the above description, in the first and second methods of the first forming and the first and second methods of the fourth forming, a method of changing the radius of curvature of the arc and changing the cross-sectional shape to be bent stepwise has been exemplified as the method of making the cross-sectional shape of the bent part 10D different by the second step 3 and the first step 2. The method of making the cross-sectional shape of the bent part 10D different by the second step 3 and the first step 2 is not limited to this. The method of making the cross-sectional shape of the bent part 10D different by the second step 3 and the first step 2 is not particularly limited in relation to the first die as long as a cross-sectional shape is such that a moment in which the vertical wall part 10B is deformed in the closing direction is generated in the bent part 10D. The same applies to a case where the cross-sectional shape of the first die is changed in the second forming and the third forming.

<Effect and Others>

Figure 7D:
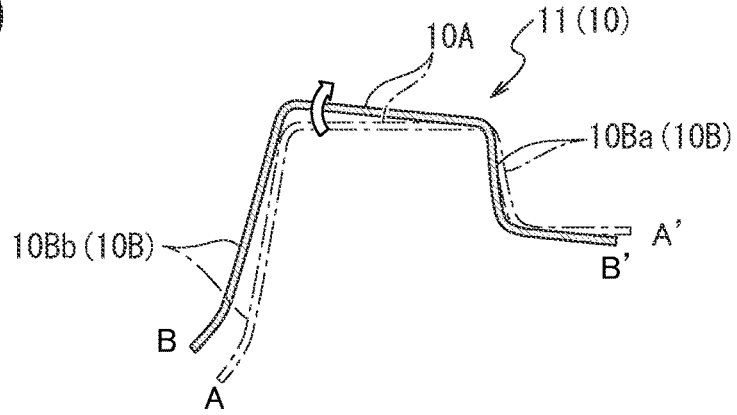

When the die is released after press forming the metal sheet 1 into the elongated curved component shape described above, as illustrated in FIG. 7, not only the cross section of the formed product 11 is changed due to springback as illustrated in FIG. 7B, but also the warpage in the longitudinal direction in which the longitudinal end portions of the component are lifted up or dropped as illustrated in FIG. 7C, or the cross section of the component end portion is twisted with respect to the cross section of the center of the component in the longitudinal direction as illustrated in FIG. 7D. Therefore, the dimensional accuracy of the formed product 10 deteriorates.

That is, as illustrated in FIG. 7B, when focusing on the cross-sectional shape of the component, for example, the angle formed on the bent part 10D, which is a boundary between the top sheet part 10A and the vertical wall part 10B, is changed, or the springback occurs so as to open the cross section due to the warpage of the vertical wall part 10B. Furthermore, as illustrated in FIG. 7C, the warpage in the longitudinal direction is generated in a direction in which the both ends of the component are lifted up or dropped due to elastic recovery, depending on the component shape. Moreover, as illustrated in FIG. 7D, when the balance of the warpage in the longitudinal direction between an outer side or an inner side of the curvature of the component in the longitudinal direction is lost, only one of the top sheet part 10A warps in the longitudinal direction, so that apparent torsion near the both ends of the component may occur.

As described above, when the elongated curved component shape is press-formed, the dimensional accuracy of the component deteriorates.

On the other hand, in the present embodiment, the press forming is performed for shape correction in the second step 3, the warpage in the longitudinal direction is suppressed, and accordingly, apparent torsion near the both ends of the component is also reduced.

That is, in the present embodiment, when the warpage in the longitudinal direction and the torsion of the formed product 11 having a hat-shaped cross-sectional shape and curved in the longitudinal direction as illustrated in FIG. 7 are generated by forming in the first step 2, the formed product 11 is controlled so that the vertical wall part 10B on at least one of the concave side 20A (inner side) and the convex side 20B (outer side) of the longitudinal curved part 20 is formed in the opening or closing direction in the second step 3. Thus, the warpage in the longitudinal direction is suppressed, and accordingly, apparent torsion near the both ends of the component is also reduced.

[Mechanism of Warpage Suppression]

The mechanism of warpage suppression will be described below.

FIGS. 12 to 15 illustrate a simple elongated curved component shape that is curved in the longitudinal direction and has a hat-shaped cross-sectional shape shape with the top sheet part 10A and the vertical wall parts 10B continuous with the top sheet part 10A. It is assumed that the total length of the shape in the longitudinal direction may be only the curved part 20, for simplicity of explanation. Although the simple component shape has no flange parts 10C, a phenomenon that occurs may be considered similar to a case where the component shape has the flange parts 10C.

Figure 12A:
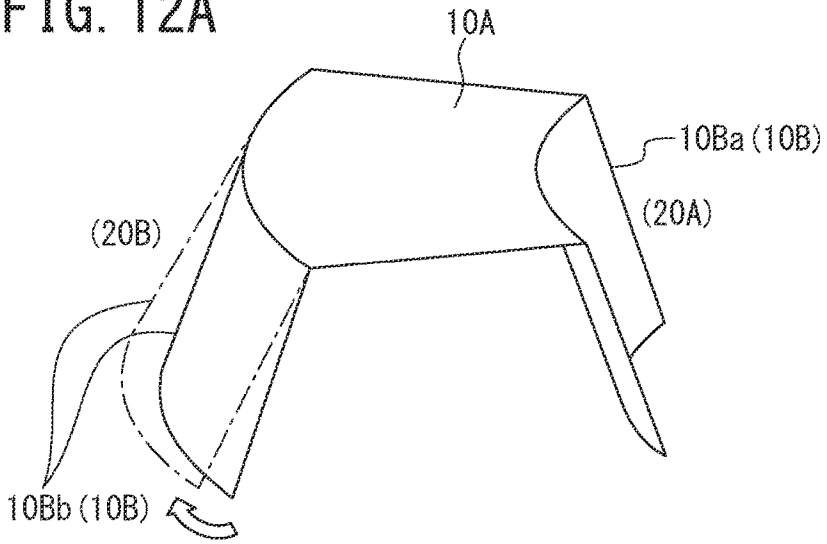
FIG. 12A to 12C are views illustrating an effect when a vertical wall part on a convex side of the curved part is deformed to be open.
Figure 12B:
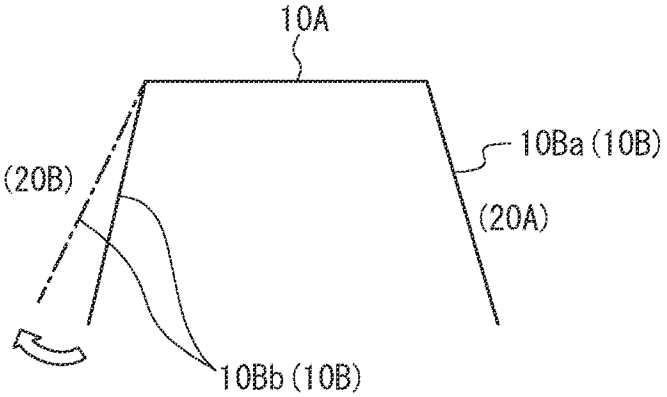
Figure 12C:
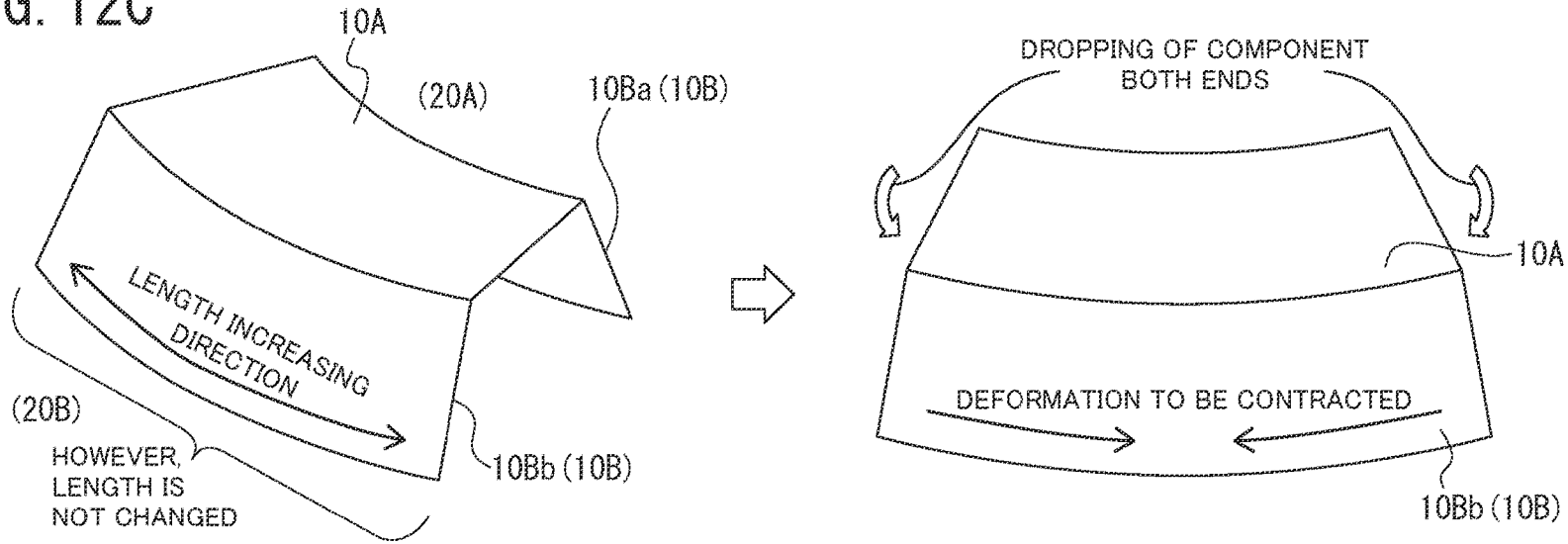

(1) Case where Angle of Vertical Wall Part 10Bb on Convex Side 20B of Curved Part 20 with Respect to Top Sheet Part 10A is Deformed to be Large As illustrated in FIG. 12, a case where the vertical wall part 10Bb on the convex side 20B in the curved part 20 is deformed in the opening direction of the cross section (direction in which an angle to the top sheet part 10A is increased) may be considered. When the vertical wall part 10Bb on the convex side 20B in the curved part 20 is deformed in the opening direction as illustrated in FIGS. 12A and 12B, the end portions (lower ends) of the vertical wall part 10Bb are not geometrically realized unless the length therebetween in the longitudinal direction is increased (see left side in FIG. 12C). However, since the length between the end portions of the vertical wall part 10Bb is not changed before and after the deformation, the end portions of the vertical wall part 10Bb are apparently deformed to be contracted in the longitudinal direction (see right side in FIG. 12C). At this time, when the cross section of the vertical wall part 10Bb is deformed in the opening direction, if the end portions of the vertical wall part 10Bb are deformed in a direction of being contracted, an upper portion of the vertical wall part 10Bb and the top sheet part 10A are trailed and stretched due to the deformation. As a result, the both ends of the component in the longitudinal direction are deformed in a direction of being dropped (see right side in FIG. 12C).

As described above, the angle formed by the vertical wall part 10Bb with respect to the top sheet part 10A on the convex side 20B in the curved part 20 is deformed in a direction of being increased in the second step 3, such that it is possible to correct the warpage in the longitudinal direction to the lifting-up direction of the component both ends. Since the formed product is an elongated curved product, it is possible to largely correct the warpage in the longitudinal direction even when the angle of the vertical wall part 10Bb of the bent part 10D is changed by about 1 degree.

Figure 13A:
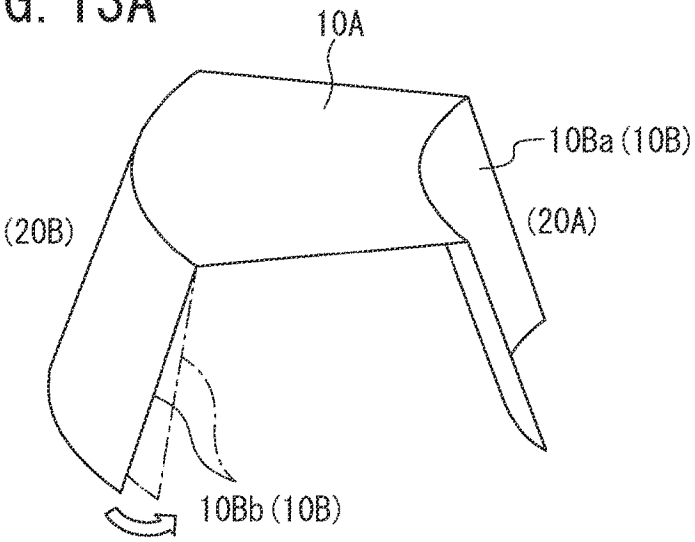
FIG. 13A to 13C are views illustrating an effect when the vertical wall part on the convex side of the curved part is deformed to be closed.
Figure 13B:
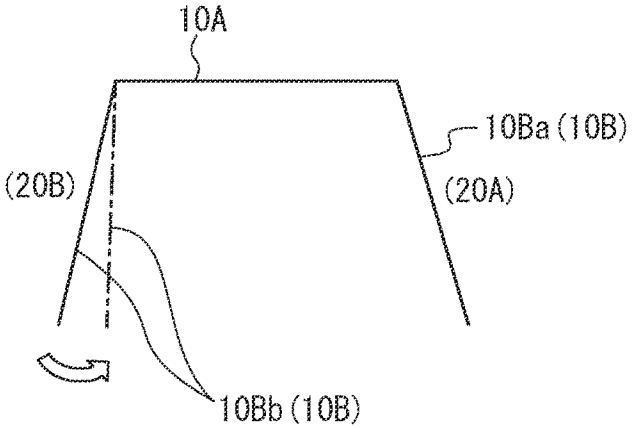
Figure 13C:
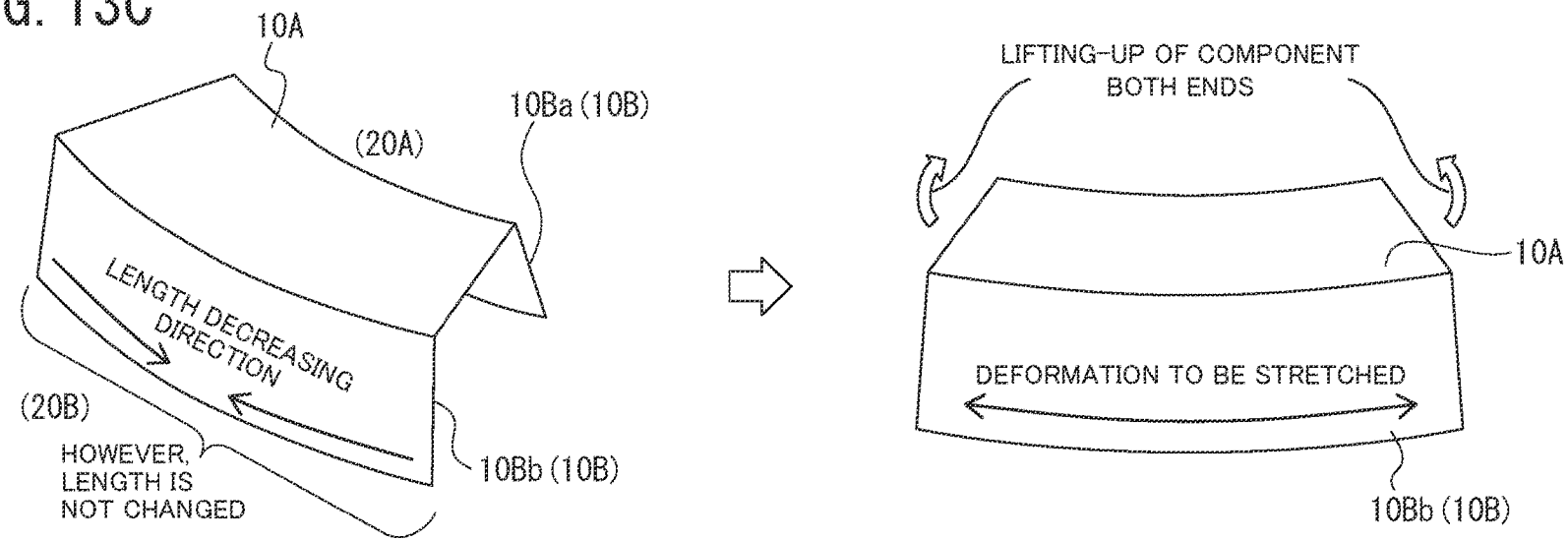

(2) Case where Angle of Vertical Wall Part 10Bb on Convex Side 20B with Respect to Top Sheet Part 10A is Deformed to be Small As illustrated in FIG. 13, a case where the vertical wall part 10Bb on the convex side 20B in the longitudinal curved part 20 is deformed in the closing direction of the cross section (direction in which an angle to the top sheet part 10A is reduced) may be considered. When the vertical wall part 10Bb on the convex side 20B in the curved part 20 is deformed in the closing direction as illustrated in FIGS. 13A and 13B, the end portions of the vertical wall part 10Bb are not geometrically realized unless the length therebetween in the longitudinal direction is decreased (see left side in FIG. 13C). However, since the length between the end portions of the vertical wall part 10Bb is not changed before and after the deformation, the end portions of the vertical wall part 10Bb are apparently deformed to be stretched (see right side in FIG. 13C). At this time, when the vertical wall part 10Bb is deformed in the closing direction of the cross section, if the end portions of the vertical wall part 10Bb are deformed in a direction of being stretched, an upper portion of the vertical wall part 10Bb and the top sheet part 10A are trailed and contracted due to the deformation. As a result, the both ends of the component in the longitudinal direction are deformed in a direction of being lifted up (see right side in FIG. 13C).

As described above, the angle formed by the vertical wall part 10Bb with respect to the top sheet part 10A on the convex side 20B in the curved part 20 is deformed in a direction of being decreased in the second step 3, such that it is possible to correct the warpage in the longitudinal direction to the dropping direction of the component both ends. Since the formed product is an elongated curved product, it is possible to largely correct the warpage in the longitudinal direction even when the angle of the vertical wall part 10Bb of the bent part 10D is changed by about 1 degree.

Figure 14A:
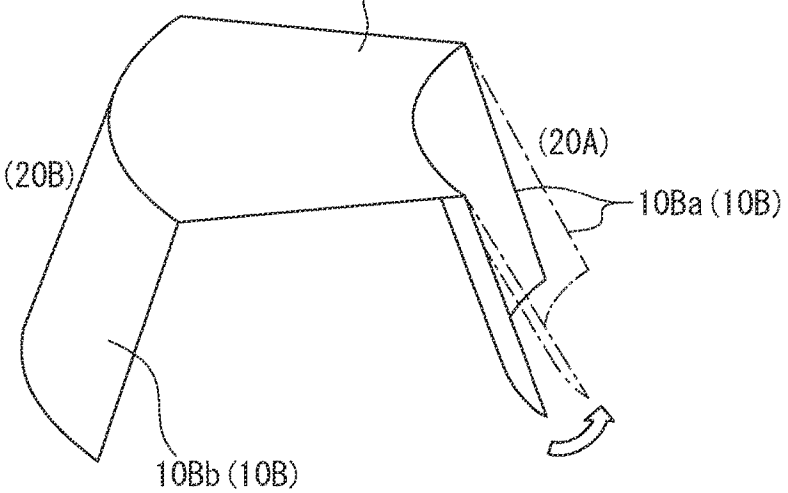
FIG. 14A to 14C are views illustrating an effect when a vertical wall part on a concave side of the curved part is deformed to be open.
Figure 14B:
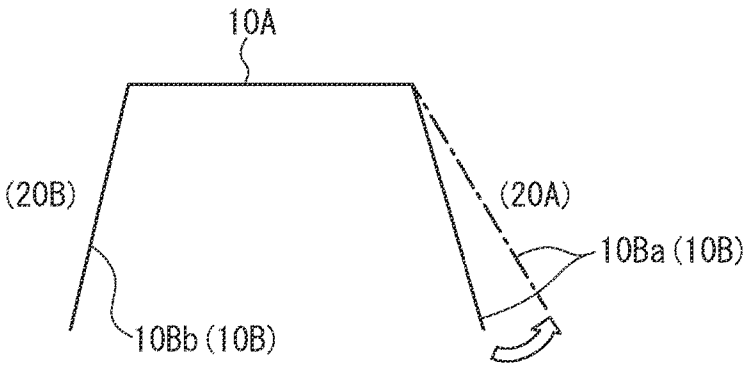
Figure 14C:
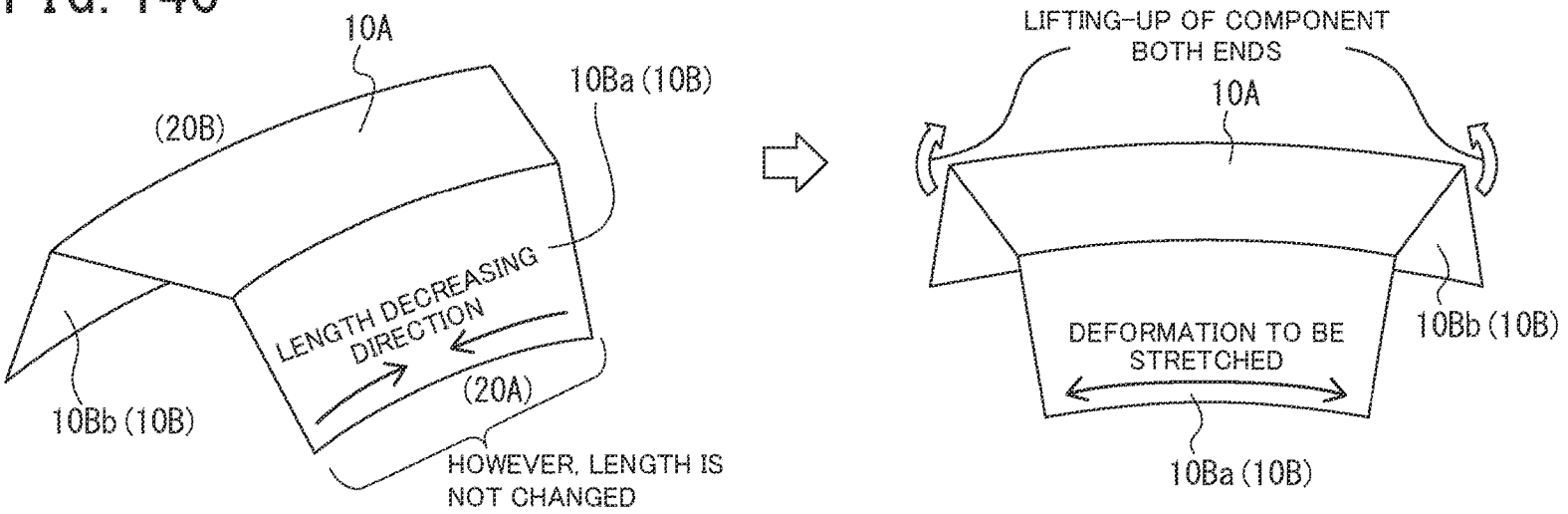

(3) Case where Angle of Vertical Wall Part 10Ba on Concave Side 20A with Respect to Top Sheet Part 10A is Deformed to be Large As illustrated in FIG. 14, a case where the vertical wall part 10Ba on the concave side 20A in the longitudinal curved part 20 is deformed in the opening direction of the cross section (direction in which an angle to the top sheet part 10A is increased) may be considered. When the vertical wall part 10Ba on the concave side 20A in the curved part 20 is deformed in the opening direction, the end portions of the vertical wall part 10Ba are not geometrically realized unless the length therebetween in the longitudinal direction is decreased (see left side in FIG. 14C). However, since the length between the end portions of the vertical wall part 10Ba is not changed before and after the deformation, the end portions of the vertical wall part 10Ba are apparently deformed to be stretched (see right side in FIG. 14C). At this time, when the vertical wall part 10Ba is deformed in the opening direction of the cross section, if the end portions of the vertical wall part 10Ba are deformed in a direction of being stretched, an upper portion of the vertical wall part 10Ba and the top sheet part 10A are trailed and contracted due to the deformation. As a result, the both ends of the component are deformed in a direction of being lifted up (see right side in FIG. 14C).

As described above, the angle formed by the vertical wall part 10Ba with respect to the top sheet part 10A on the concave side 20A in the curved part 20 is deformed in a direction of being increased in the second step 3, such that it is possible to correct the warpage in the longitudinal direction to the dropping direction of the component both ends. Since the formed product is an elongated curved product, it is possible to largely correct the warpage in the longitudinal direction even when the angle of the vertical wall part 10Ba of the bent part 10D is changed by about 1 degree.

Figure 15A:
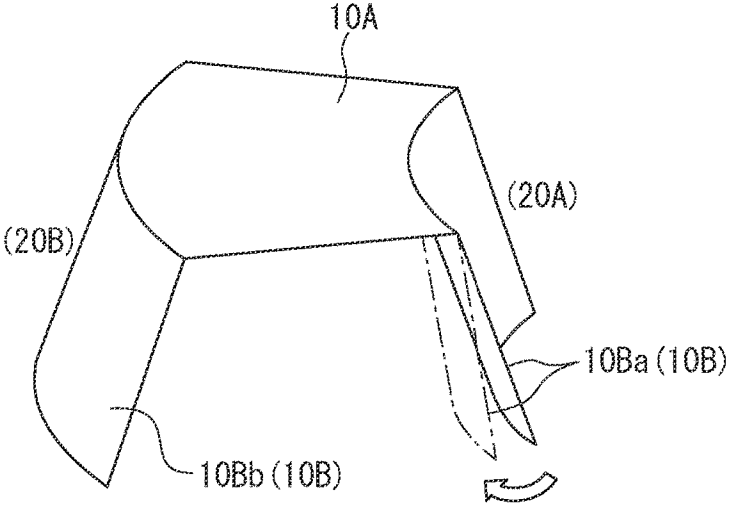
FIG. 15A to 15C are views illustrating an effect when the vertical wall part on the concave side of the curved part is deformed to be closed.
Figure 15B:
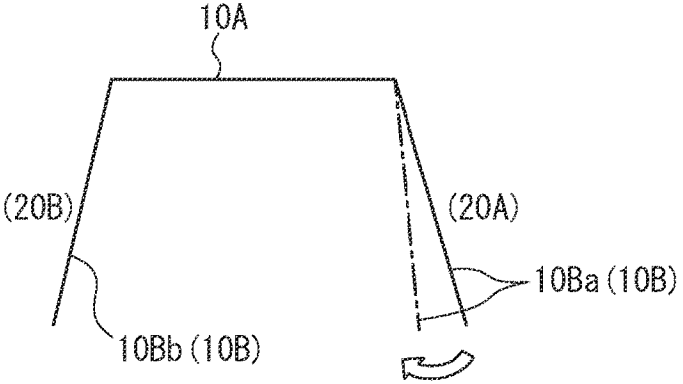
Figure 15C:
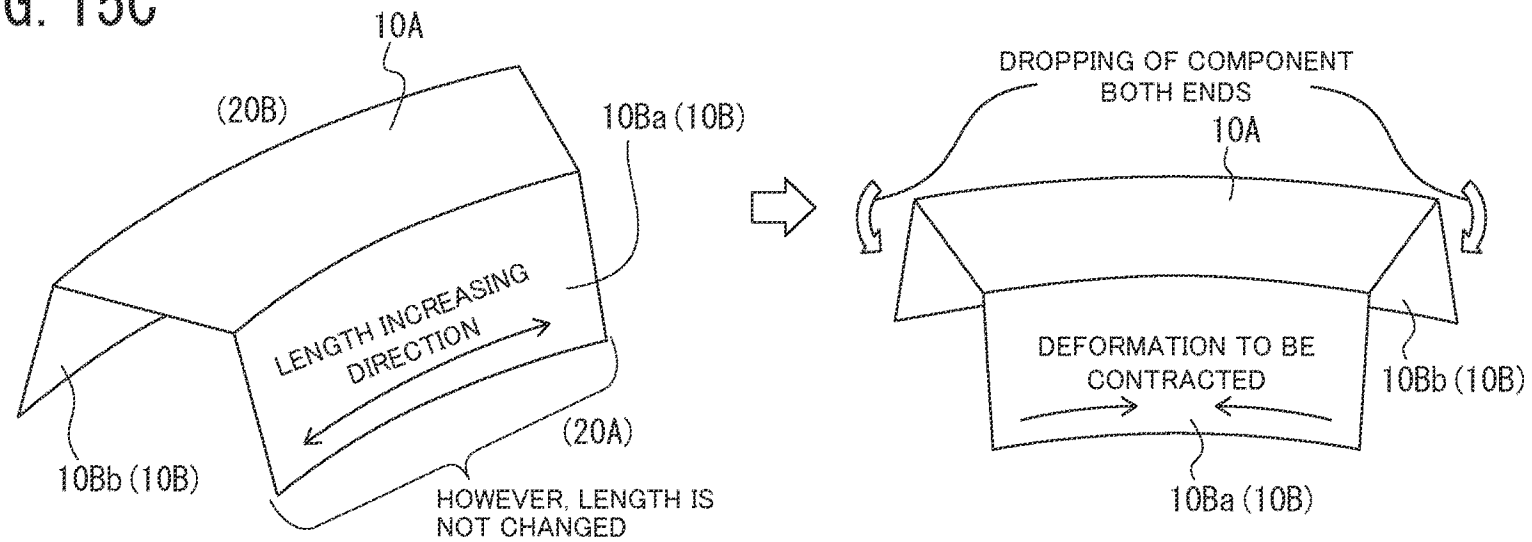

(4) Case where Angle of Vertical Wall Part 10Ba on Concave Side 20A with Respect to Top Sheet Part 10A is Deformed to be Small As illustrated in FIG. 15, a case where the vertical wall part 10Ba on the concave side 20A in the longitudinal curved part 20 is deformed in the closing direction of the cross section (direction in which an angle to the top sheet part 10A is reduced) may be considered. When the vertical wall part 10Ba on the concave side 20A in the curved part 20 is deformed in the closing direction, the end portions of the vertical wall part 10Ba are not geometrically realized unless the length therebetween in the longitudinal direction is increased (see left side in FIG. 15C). However, since the length between the end portions of the vertical wall part 10Ba is not changed before and after the deformation, the end portions of the vertical wall part 10Ba are apparently deformed to be contracted (see right side in FIG. 15C). At this time, when the vertical wall part 10Ba is deformed in the closing direction of the cross section, if the end portions of the vertical wall part 10Ba are deformed in a direction of being contracted, an upper portion of the vertical wall part 10Ba and the top sheet part 10A are trailed and stretched due to the deformation. As a result, the both ends of the component are deformed in a direction of being dropped (see right side in FIG. 15C).

As described above, the angle formed by the vertical wall part 10Ba with respect to the top sheet part 10A on the concave side 20A in the curved part 20 is deformed in a direction of being reduced in the second step 3, such that it is possible to correct the warpage in the longitudinal direction to the lifting-up direction of the component both ends. Since the formed product is an elongated curved product, it is possible to largely correct the warpage in the longitudinal direction even when the angle of the vertical wall part 10Ba of the bent part 10D is changed by about 1 degree.

Based on the above findings, a forming analysis or actual press forming test is once performed on the formed product 10 of the elongated curved component shape fabricated by press forming up to the first step 2, thereby determining a direction or magnitude of the generated warpage in the longitudinal direction of the component. Then, the press forming is performed on a part of the curved part 20 so as to be deformed in a direction opposite to the determined direction of the warpage in the second step 3. An angular variation of the vertical wall part 10B deformed in the second step 3 is determined from an angle in which the warpage obtained by the forming analysis is reduced to perform the press forming in the second step 3 so that the vertical wall part 10B is deformed by the angle. As described above, since the component is an elongated component, it is possible to sufficiently exert a warpage correction effect by about one or more degrees, and it is effective in improvement on dimensional accuracy of the component.

That is, for a case of deforming the component both ends in a dropping direction, it is effective to deform the vertical wall part 10Bb of the convex side 20B of the longitudinal curved part 20 in the opening direction of the cross section or to deform the vertical wall part 10Ba of the concave side 20A of the longitudinal curved part 20 in the closing direction of the cross section. Alternatively, the vertical wall part 10Bb of the convex side 20B of the longitudinal curved part 20 is deformed in the opening direction of the cross section, and the vertical wall part 10Ba of the concave side 20A of the longitudinal curved part 20 is deformed in the closing direction of the cross section.

On the contrary, for a case of deforming the end portions in the longitudinal direction in the lifting-up direction, it is effective to deform the vertical wall part 10Bb of the convex side 20B of the longitudinal curved part 20 in the closing direction of the cross section or to deform the vertical wall part 10Ba of the concave side 20A of the longitudinal curved part 20 in the opening direction of the cross section. Alternatively, the vertical wall part 10Bb of the convex side 20B of the longitudinal curved part 20 is deformed in the closing direction of the cross section, and the vertical wall part 10Ba of the concave side 20A of the longitudinal curved part 20 is deformed in a direction in the opening direction of the cross section.

Although the correction control of the warpage by forming the cross section of the vertical wall part 10B to be opened or closed has been described in the above description, it is not necessary to directly change all the cross sections of the vertical wall part 10B in the longitudinal direction. Even if the cross-sectional shape of a part of the bent part 10D in the longitudinal direction of the bent part 10D is formed so as to be different from that of the first die, it is possible to control the warpage in the longitudinal direction by opening or closing the cross section of the vertical wall part 10B by a moment generated in the bent part during release.

Measures for changing the radius of curvature of the bent part 10D may not be performed on the entire component in the longitudinal direction or may be performed at least a part of the curved part 20.

[Regarding Effect by Changing Cross-Sectional Shape of Bent Part 10D]

Next, reasons why the cross section of the targeted portion of the vertical wall part 10B is able to be formed so as to be closed or opened by making the cross-sectional shape of the bent part 10D in the curved part 20 different from those of the first die and the second die will be described.

As in "first and second methods of the first forming" or "first and second methods of the fourth forming" described above, effects of making the targeted cross-sectional shape of the bent part 10D in the second die different from that at the same position in the first step 2 will be described hereinafter.

(1) First, a case where the cross-sectional shape is changed with the radius of curvature of the bent part 10D in the first step 2 and the radius of curvature of the bent part 10D in the second step 3 as a different radius, will be described.

Figure 16A:
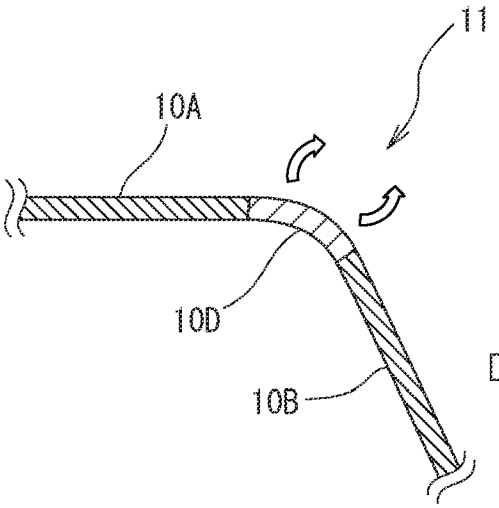
FIG. 16A to 16C are views illustrating an effect when a radius of curvature of the bent part located in the curved part is increased.
Figure 16B:
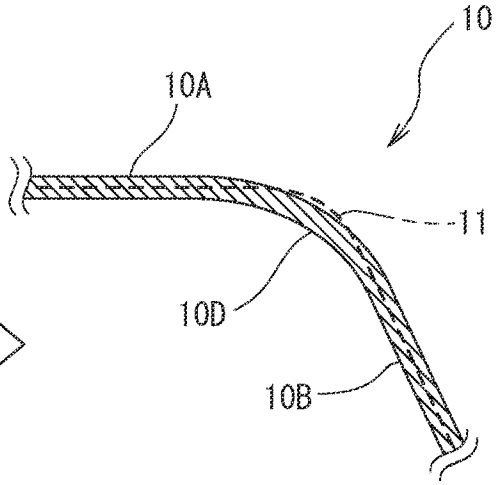
Figure 16C:
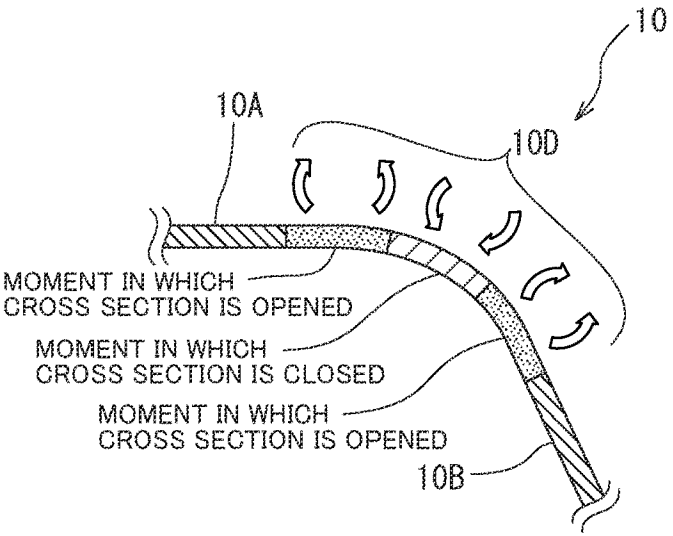
Figure 17A:
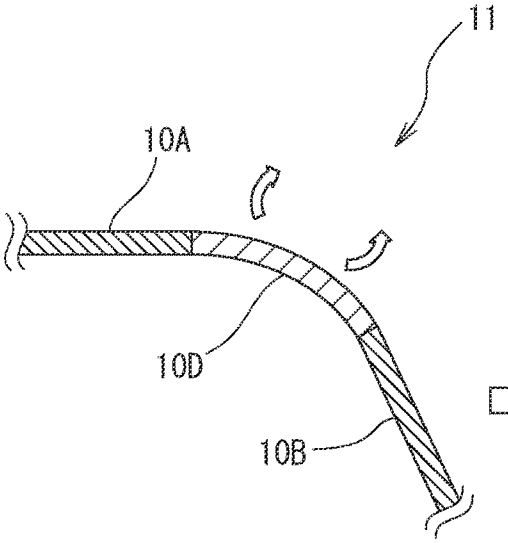
FIG. 17A to 17C are views illustrating an effect when a radius of curvature of the bent part located in the curved part is reduced.
Figure 17B:
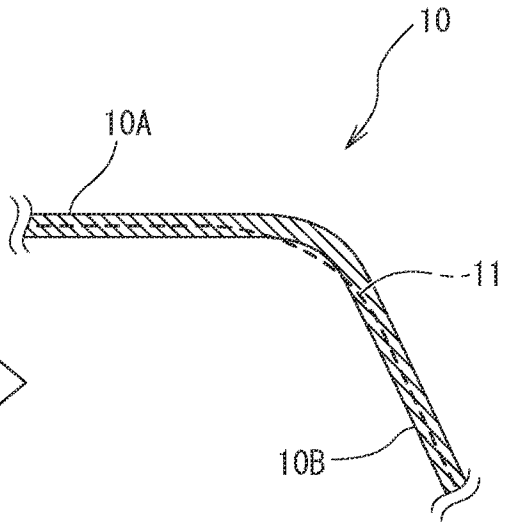
Figure 17C:
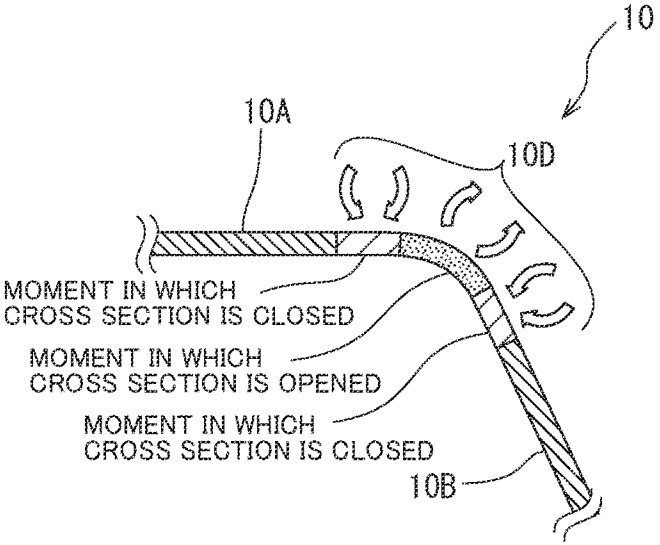

FIGS. 16 and 17 illustrate a method of changing the radius of curvature of the bent part 10D existing at the boundary between the top sheet part 10A and the vertical wall part 10B during the first step 2 and the second step 3 to change a deformed form of the vertical wall part 10B.

When the radius of curvature of the bent part 10D existing at the boundary between the top sheet part 10A and the vertical wall part 10B is changed, an inclination of the vertical wall part 10B with respect to the top sheet part 10A is changed. That is, when a moment is generated in the direction in which the radius of curvature of the bent part 10D is larger than that in the first step 2, the vertical wall part 10B is deformed in the direction in the opening direction of the cross section more than the current state. On the other hand, when a moment is generated in the direction in which the radius of curvature of the bent part 10D is smaller than that of the current state, the vertical wall part 10B is deformed in the direction in the closing direction of the cross section more than the current state.

The measures for changing the radius of curvature of the bent part 10D may not be performed on the entire component in the longitudinal direction or may be performed at least a part of the curved part 20.

(1-1) Case of Radius of Curvature of Bent Part 10D of First Step 2<Radius of Curvature of Bent Part 10D of Second Step 3 (See FIG. 16)

In the first step 2, as illustrated in FIG. 16A, a moment in an opening direction of the cross section is generated in the bent part 10D. Next, as illustrated in FIG. 16B, in a case where the radius of curvature of the bent part 10D in the first step is smaller than the radius of curvature of the bent part 10D in the second step 3, when the forming is performed by the second step 3 with the radius of curvature larger than the radius of curvature of the bent part 10D in the first step 2, the radius of curvature near the center of the bent part 10D is increased. As a result, the moment in a closing direction of the cross section is generated. On the other hand, both adjacent portions of the bent part 10D, which has not been bent in the first step 2, are bent by the second step 3, and thus the moment in the opening direction of the cross section is generated.

The two bending moments are adjusted, such that it is possible to generate the bending moment in the bent part 10D by changing the vertical wall part 10B in the closing direction as a whole. That is, the radius of curvature of the bent part 10D is appropriately combined in the first step 2 and the second step 3, such that it is possible to recover the elasticity of the cross section of the vertical wall part 10B in the closing direction by press forming due to the release of the die after forming in the second step 3.

(1-2) Case of Radius of Curvature of Bent Part 10*d* of First Step 2>Radius of Curvature of Bent Part 10D of Second Step 3 (See FIG. 17)

In the first step 2, as illustrated in FIG. 17A, a moment in the opening direction of the cross section is generated in the bent part 10D. Next, as illustrated in FIG. 17B, in a case where the radius of curvature of the bent part 10D in the first step 2 is larger than the radius of curvature of the bent part 10D in the second step 3, when the forming is performed by the second step 3 with the radius of curvature smaller than the radius of curvature of the bent part 10D in the first step 2, the radius of curvature near the center of the bent part 10D is reduced. As a result, the moment in the opening direction of the cross section is generated. On the other hand, both adjacent portions of the bent part 10D, which has bent in the first step 2, are formed at a contour on a linear shape side by the second step 3, and thus the moment in the closing direction of the cross section is generated.

The two bending moments are adjusted, such that it is possible to generate the bending moment in the bent part 10D by changing the vertical wall part 10B in the closing direction as a whole. That is, the radius of curvature of the bent part 10D is appropriately combined in the first step 2 and the second step 3, such that it is possible to recover the elasticity of the cross section of the vertical wall part 10B in the closing direction by press forming due to the release of the die after forming in the second step 3.

(2) A case where the cross-sectional shape of the bent part 10D in the first step 2 and the cross-sectional shape of the bent part 10D in the second step 3 are changed as a surface shape that is bent stepwise at the plurality of points from the top sheet part 10A toward the vertical wall part 10B in the bent part 10D, will be described.

Here, a case where the shape that is bent stepwise at the plurality of points from the top sheet part 10A toward the vertical wall part 10B is a chamfered shape in which a central portion of the bent part 10D with arc cross-sectional shape is chamfered as illustrated in FIG. 18.

Figure 18A:
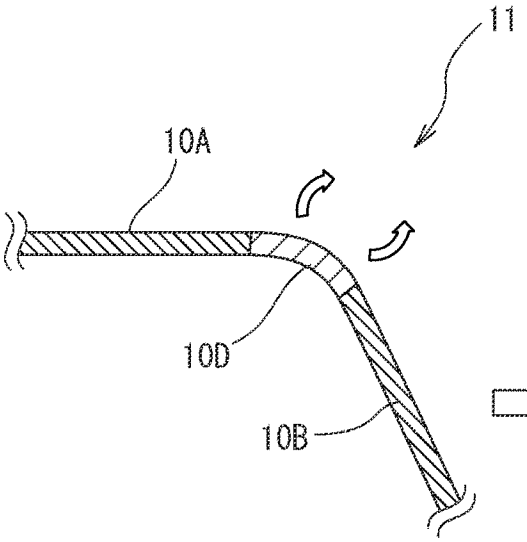
FIG. 18A to 18C are views illustrating an effect in which a cross-sectional shape of the bent part is deformed to be bent stepwise at a plurality of points.
Figure 18B:
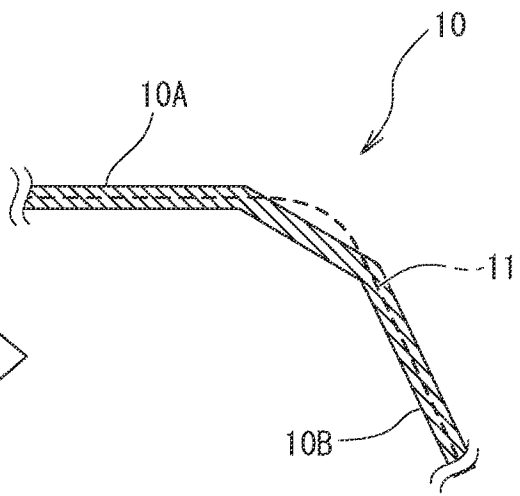
Figure 18C:
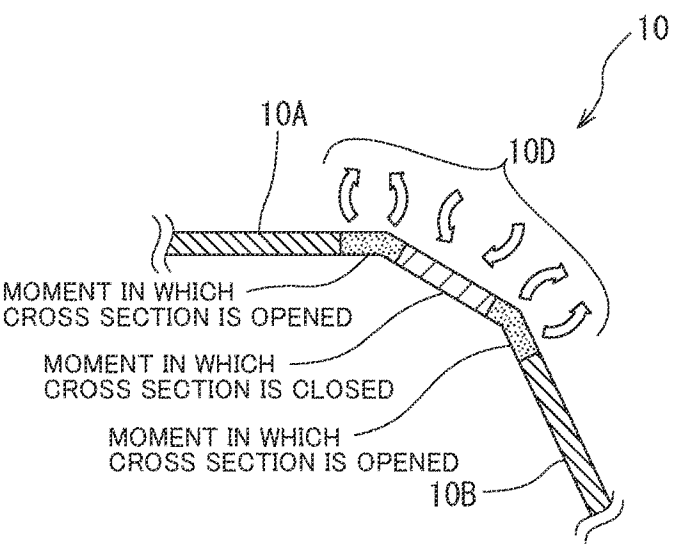

In the first step 2, as illustrated in FIG. 18A, a moment in the opening direction of the cross section is generated in the bent part 10D. The central portion of the bent part 10D is formed in a linear shape as illustrated in FIG. 18B by forming the chamfered shape in the bent part 10D by the second step 3, which is thus equivalent to the case where the radius of curvature is made large, and the moment in the closing direction of the cross section is generated on the center side of the bent part 10D as illustrated in FIG. 18C. On the other hand, the moment in the opening direction of the cross section is generated in the bent part 10D at both adjacent portions of a chamfered part (linear part).

The two bending moments are adjusted, such that it is possible to generate the bending moment in the bent part 10D by changing the vertical wall part 10B in the closing direction as a whole. That is, the cross-sectional shape of the bent part 10D is appropriately combined in the first step 2 and the second step 3, such that it is possible to recover the elasticity of the cross section of the vertical wall part 10B in the closing direction by press forming due to the release of the die after forming in the second step 3.

The measures for forming the bent part 10D in the chamfered shape by the second step 3 may not be performed on the entire component in the longitudinal direction or may be performed at least a part of the bent part 10D.

As described above, even if the forming surface that abuts on the top sheet part 10A may be set to be the same as the forming surface that abuts on the vertical wall part 10B with the first die and the second die, it is possible to perform the press forming so that the targeted cross section of the vertical wall part 10B is deformed in the closing direction of the cross section by making the cross-sectional shape of the portion forming the bent part 10D with the first die different from the cross-sectional shape of the portion forming the bent part 10D with the second die, that is, by controlling the targeted cross-sectional shape of the bent part 10D in the second step 3 relative to the targeted cross-sectional shape of the bent part 10D in the first step 2.

By controlling the cross-sectional shape of the portion forming the bent part 10D with the first die and the cross-sectional shape of the portion forming the bent part 10D with the second die to be different from each other, it is also possible to set the press forming so that the targeted cross section of the vertical wall part 10B is deformed in the opening direction due to the springback during release.

However, since the cross section of the vertical wall part 10B is sprung back in the opening direction in the first step 2, it is preferable to control the cross section of the vertical wall part 10B to be deformed in the closing direction in the second step 3.

<Effect>

As described above, according to the present embodiment, it is possible to suppress the warpage or torsion in the longitudinal direction, when the formed product is manufactured by press forming, the formed product 10 formed of a component shape having a hat-shaped cross-sectional shape and a curved part 20 being curved so as to be convex toward one side of a top sheet part 10A in a width direction when viewed in plan view along a longitudinal direction of the top sheet part 10A.

Particularly, when the cross-sectional shape of the bent part 10D in the second step 3 is changed and corrected into the cross-sectional shape of the bent part 10D in the first step 2 in the curved part 20, it is possible to easily suppress the warpage or torsion in the longitudinal direction while suppressing adverse effects on the shapes of other component shapes.

As a result, according to the method of the present embodiment, it is possible to provide the formed product 10 of an elongated curved component shape with excellent shape fixability.

Example

Next, an example based on the present invention will be described.

Figure 19A:
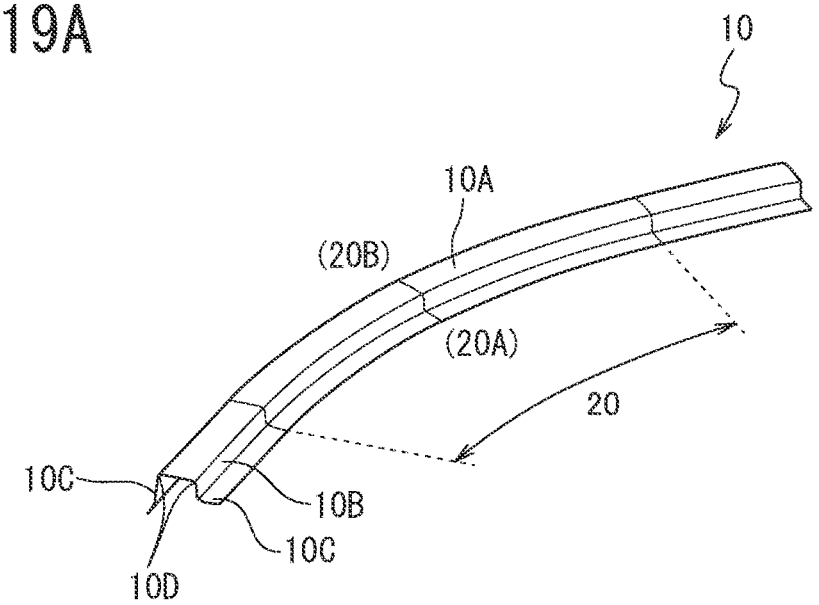
Figure 19B:
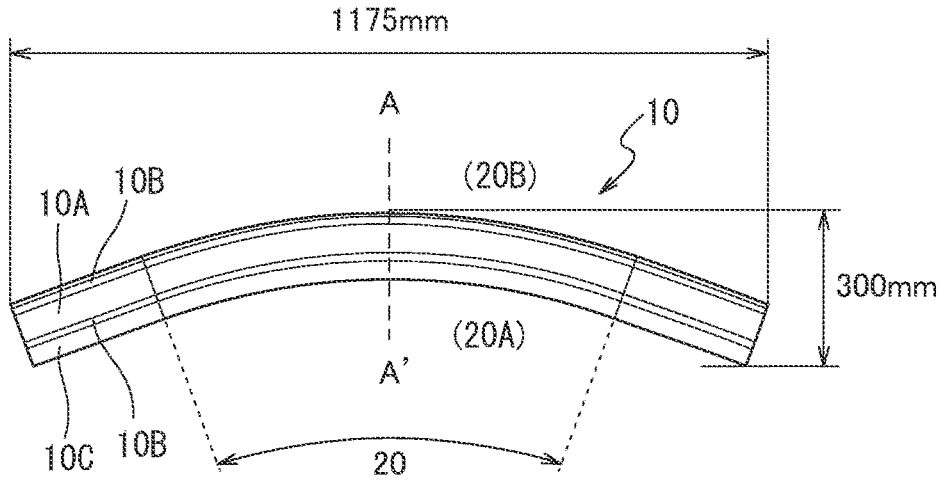
Figure 19C:
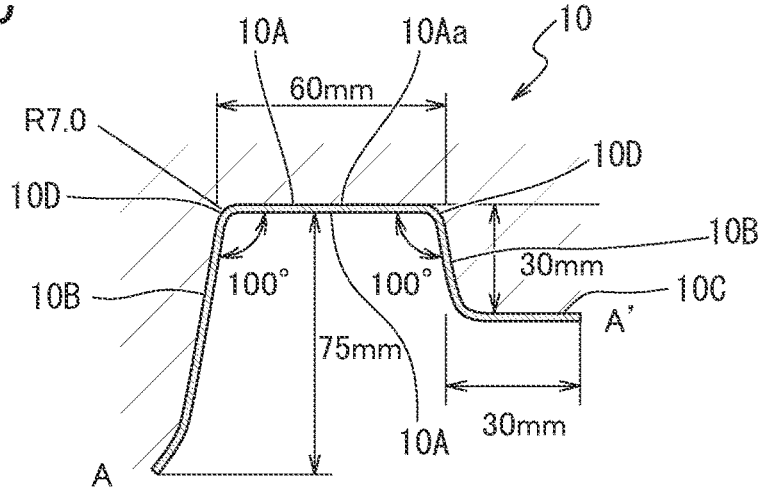

A material condition was set to use a 980 Mpa class cold-rolled steel sheet (thickness of 1.2 mm) as the metal sheet 1. A component shape has dimensions as illustrated in FIG. 19, has the top sheet part 10A and the vertical wall parts 10B and the flange parts 10C continuous with the top sheet part 10A, and a forming analysis of forming the component shape into a formed product shape that is curved along the longitudinal direction of the component when viewed in plan view was performed as the press forming in the first step 2.

A condition was set in which the die used for forming was the die for drawing illustrated in FIG. 3. At this time, forming conditions were set in which a pressure of the blank holder was 80 tons and a stroke of the blank holder was 80 mm in the die. Further, the friction coefficient between the die and the metal sheet 1 is 0.12, which was constant.

After the drawing as in FIG. 4, unnecessary portions are trimmed, and then a springback analysis was performed.

At this time, springback in which the longitudinal end portions of the component is warped in a direction of being lifted up, respectively, occurred in the first component shape due to the release after forming into the component shape by press forming in the first step 2, and an amount of warpage due to the release was 7.2 mm at both end portions of the component shape in the longitudinal direction.

Figure 20:
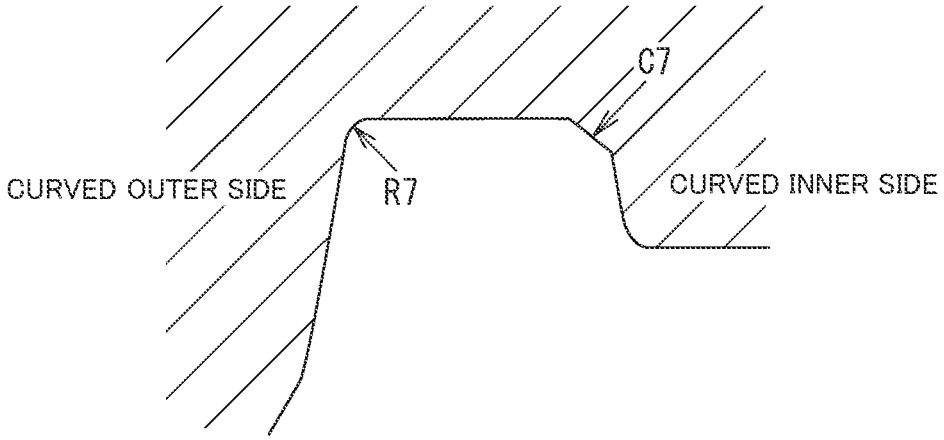
FIG. 20 is a view illustrating a cross-sectional shape of a die for reforming according to the Example.
Figure 21:
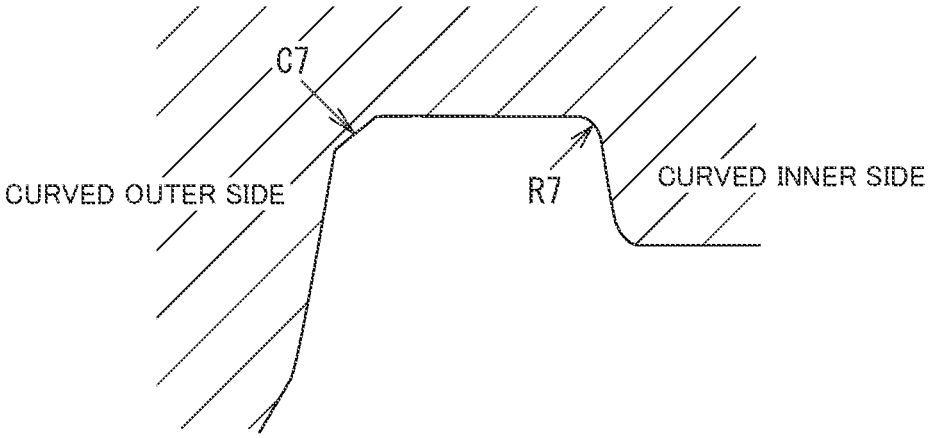
FIG. 21 is a view illustrating another cross-sectional shape of a die for reforming according to the Example.

Next, In the press forming of the second step 3, a first component having the first component shape in which warpage is generated in the end portions in the longitudinal direction and a second component having the second component shape that is formed with the two dies having cross-sectional shapes illustrated in FIGS. 20 and 21 were fabricated.

Here, the cross-sectional shape of the die illustrated in FIG. 20 had a chamfered shape so that in the bent part present at the boundary between the top sheet part and the vertical wall part continuous with the top sheet part, the bent part on the convex side of the curved part (referred to as curved outer side) had a fillet shape with a radius of curvature R of 7 mm, which is the same as a first forming die, and the bent part on the concave side of the curved part (referred to as curved inner side) had a linear part C7 of 7 mm.

When the first component is reformed in a die shape in FIG. 20, the angle formed by the top sheet part and the vertical wall part on the curved outer side was not changed, but when the angle formed by the top sheet part and the vertical wall part on the curved inner side was changed in a direction of being reduced, it was observed that the both longitudinal end portions of the component were dropped. That is, it was observed that the warpage of the longitudinal end portions of the component was changed in a direction of being improved.

On the other hand, the cross-sectional shape of the die illustrated in FIG. 21 had a chamfered shape so that in the bent part present at the boundary between the top sheet part and the vertical wall part continuous with the top sheet part, the bent part on the curved outer side had the linear part C7 of 7 mm, and the bent part on the curved inner side had a fillet shape with the radius of curvature R of 7 mm, which is the same as the first forming die.

When the first component is reformed in a die shape in FIG. 21, the angle formed by the top sheet part and the vertical wall part on the curved outer side was changed in a direction of being reduced, and when the angle formed by the top sheet part and the vertical wall part on the curved inner side was not changed, it was observed that the both longitudinal end portions of the component were lifted up. That is, it was observed that the warpage of the longitudinal end portions of the component was changed in a direction of being deteriorated.

After reforming, with the second die, the first components having the cross-sectional shapes illustrated in FIGS. 20 and 21, respectively, the springback analysis was performed.

Figure 22:
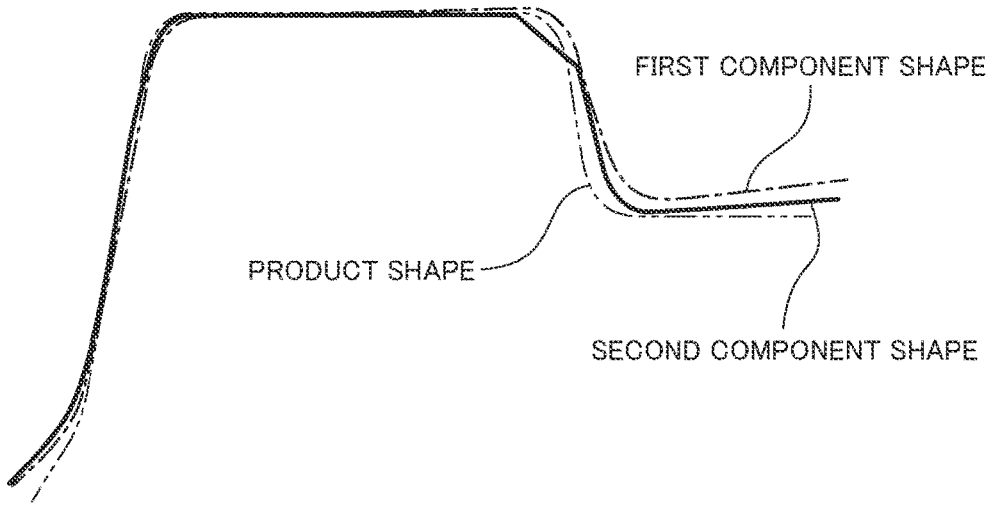
FIG. 22 is a view illustrating a change in cross-sectional shape of the die when the die in FIG. 20 is used.
Figure 23:
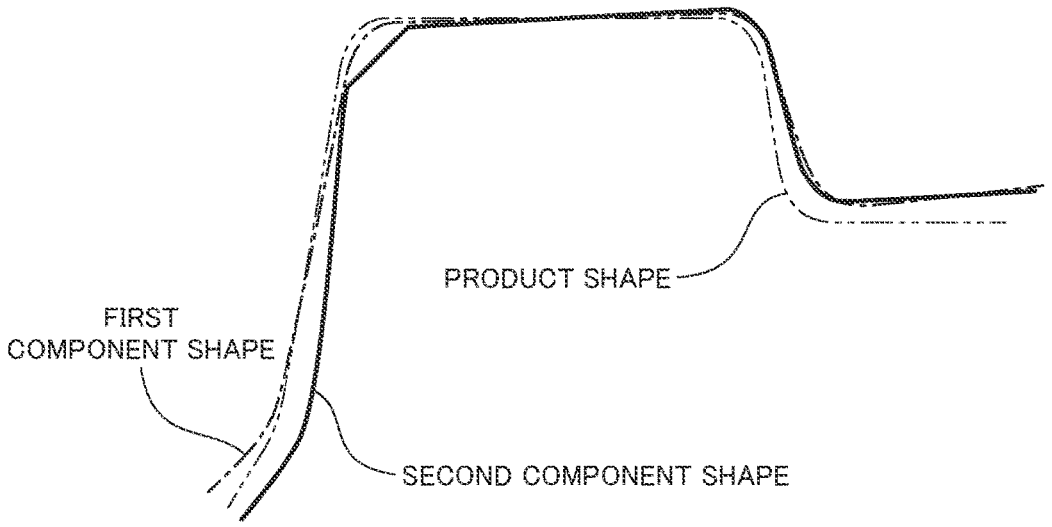
FIG. 23 is a view illustrating a change in cross-sectional shape of the die when the die in FIG. 21 is used.

FIGS. 22 and 23 illustrate a comparison between the cross-sectional shape reformed in FIGS. 20 and 21 and the cross-sectional shape after the springback.

As shown in FIG. 22, by reforming of the cross-sectional shape illustrated in FIG. 20 with the die, although the angle formed by the top sheet part and the vertical wall part on the curved outer side was hardly changed, it was found that the angle formed by the top sheet part and the vertical wall part on the curved inner side was reduced.

Then, it was observed according to the springback analysis that the amount of warpage on the longitudinal end portions of the component was improved to 4.5 mm at both ends for the desired product shape due to the change of the cross-sectional shape as described above.

On the other hand, as shown in FIG. 23, by reforming the cross-sectional shape illustrated in FIG. 21 with the die, although the angle formed by the top sheet part and the vertical wall part on the curved outer side was reduced, the angle formed by the top sheet part and the vertical wall part on the curved inner side was hardly changed.

Then, it was observed according to the springback analysis that the warpage on the longitudinal end portions of the component was deteriorated to 8.5 mm at both ends for the desired product shape due to the change of the cross-sectional shape as described above.

The above results are summarized as in Table 1.

TABLE 1

| | Shape of bent part in first step | | Shape of bent part in second step | | Amount of warpage of |
|---|---|---|---|---|---|
| Case | Curved outer side | Curved inner side | Curved outer side | Curved inner side | component end portion |
| 1 | Radius of curvature 7 mm | Radius of curvature 7 mm | None | None | 7.2 |
| 2 | Radius of curvature 7 mm | Radius of curvature 7 mm | Radius of curvature 7 mm | Chamfering of linear part of 7 mm | 4.5 |
| 3 | Radius of curvature 7 mm | Radius of curvature 7 mm | Chamfering of linear part of 7 mm | Radius of curvature 7 mm | 8.5 |

As shown in Table 1, the shape of the bent part 10D is changed in the second step 3 to deform the cross section of the vertical wall part 10B in the closing direction in the curved part 20, such that it was found that the warpage in the longitudinal direction is controlled and the shape correction is able to be performed in the desired direction.

Priority is claimed to Japanese Patent Application No. 2019-094834 (filed on May 20, 2019), the entire contents of which are incorporated herein by reference. Although the present invention has been described with reference to the definite number of embodiments, the scope of the present invention is not limited thereto and modifications of the embodiments based on the above disclosure are obvious to those skilled in the art.

REFERENCE SIGNS LIST

1 metal sheet
2 first step
3 second step
10 formed product
10A top sheet part
10Aa front side
10Ab back side
10B vertical wall part
10Ba vertical wall part on concave side
10Bb vertical wall part on convex side
10C flange part
10D bent part
11 formed product (after first step)
20 curved part
20A concave side
20B convex side

The invention claimed is:

1. A method for manufacturing a pressed component in which a metal sheet is press-formed in a component shape that has a hat-shaped cross-sectional shape and has a curved part that is curved to be convex toward one side of a top sheet part in a width direction when viewed in plan view along a longitudinal direction of the top sheet part, the hat-shaped cross-sectional shape having continuous vertical wall parts on both sides of the top sheet part in the width direction via a bent part, to manufacture a formed product, the method comprising:

a first step of press forming the metal sheet in the component shape using a first die, wherein the component shape of the formed product after release from the first die is defined as a first component shape, and a second step of press forming the formed product using a second die after the first step, wherein during the second step:

determining whether warpage in the formed product formed of the first component shape caused by elastic recovery due to the release from the first die is a first warp pattern in which longitudinal end portions of the component are lifted up to a front side of the top sheet part by elastic recovery due to the release from the first die or a second warp pattern in which the longitudinal end portions of the component are dropped to a back side of the top sheet part by elastic recovery due to the release from the first die, press forming, when the warpage is determined to be the first warp pattern, of performing at least one of first forming in which angle formed by the vertical wall part with respect to the top sheet part on a concave side in the curved part is smaller than that of the first component shape and second forming in which an angle formed by the vertical wall part with respect to the top sheet part on a convex side in the curved part is larger than that of the first component shape is performed in the second step, and press forming, when the warpage is determined to be the second warp pattern, of performing at least one of third forming in which an angle formed by the vertical wall part with respect to the top sheet part on the concave side in the curved part is larger than that of the first component shape and fourth forming in which an angle formed by the vertical wall part with respect to the top sheet part on the convex side in the curved part is smaller than that of the first component shape is performed in the second step.

2. The method for manufacturing a pressed component according to claim 1, wherein:

at least the first forming is performed in the second step when the warpage is determined to be the first warp pattern, at least the fourth forming is performed in the second step when the warpage is determined to be the second warp pattern, in the first forming, by forming a cross-sectional shape of at least a part of the bent part located on the concave side in the curved part from the top sheet part toward the vertical wall part in a shape different from a cross-sectional shape in the first step, the angle formed by the vertical wall part with respect to the top sheet part on the concave side in the curved part is formed to be smaller than that of the first component shape, and in the fourth forming, by forming a cross-sectional shape of at least a part of the bent part located on the convex side in the curved part from the top sheet part toward the vertical wall part in a shape different from a cross-sectional shape in the first step, the angle formed by the vertical wall part with respect to the top sheet part on the convex side in the curved part is formed to be smaller than that of the first component shape.

3. The method for manufacturing a pressed component according to claim 2, wherein in at least one of the first forming and the fourth forming, by forming a radius of curvature of the cross-sectional shape of the bent part from the top sheet part toward the vertical wall part with a radius of curvature different from that in the first step, a shape different from the cross-sectional shape in the first step is made.

4. The method for manufacturing a pressed component according to claim 3, wherein in at least one of the first forming and the fourth forming, by forming the cross-sectional shape of the bent part from the top sheet part toward the vertical wall part in a shape that is bent stepwise at a plurality of points from the top sheet part toward the vertical wall part, a shape different from the cross-sectional shape in the first step is made.

5. The method for manufacturing a pressed component according to claim 4, wherein the second die includes an angle formed by a forming surface abutting on the vertical wall part with respect to a forming surface abutting on the top sheet part is the same as an angle formed by a forming surface abutting on the vertical wall part with respect to a forming surface abutting on the top sheet part in the first die.

6. The method for manufacturing a pressed component according to claim 4, wherein the press forming in the first step is bending or drawing.

7. The method for manufacturing a pressed component according to claim 3, wherein the second die includes an angle formed by a forming surface abutting on the vertical wall part with respect to a forming surface abutting on the top sheet part is the same as an angle formed by a forming surface abutting on the vertical wall part with respect to a forming surface abutting on the top sheet part in the first die.

8. The method for manufacturing a pressed component according to claim 3, wherein the press forming in the first step is bending or drawing.

9. The method for manufacturing a pressed component according to claim 2, wherein in at least one of the first forming and the fourth forming, by forming the cross-sectional shape of the bent part from the top sheet part toward the vertical wall part in a shape that is bent stepwise at a plurality of points from the top sheet part toward the vertical wall part, a shape different from the cross-sectional shape in the first step is made.

10. The method for manufacturing a pressed component according to claim 9, wherein the second die includes an angle formed by a forming surface abutting on the vertical wall part with respect to a forming surface abutting on the top sheet part is the same as an angle formed by a forming surface abutting on the vertical wall part with respect to a forming surface abutting on the top sheet part in the first die.

11. The method for manufacturing a pressed component according to claim 9, wherein the press forming in the first step is bending or drawing.

12. The method for manufacturing a pressed component according to claim 2, wherein the second die includes an angle formed by a forming surface abutting on the vertical wall part with respect to a forming surface abutting on the top sheet part is the same as an angle formed by a forming surface abutting on the vertical wall part with respect to a forming surface abutting on the top sheet part in the first die.

13. The method for manufacturing a pressed component according to claim 2, wherein the press forming in the first step is bending or drawing.

14. The method for manufacturing a pressed component according to claim 2, wherein a steel sheet having a tensile strength of 440 MPa or more is used for the metal sheet which is press-formed.

15. The method for manufacturing a pressed component according to claim 1, wherein the press forming in the first step is bending or drawing.

16. The method for manufacturing a pressed component according to claim 1, wherein a steel sheet having a tensile strength of 440 MPa or more is used for the metal sheet which is press-formed.

* * * * *